US010724788B2

(12) United States Patent
Choi

(10) Patent No.: US 10,724,788 B2
(45) Date of Patent: Jul. 28, 2020

(54) REFRIGERATOR

(71) Applicant: LG Electronics Inc., Seoul (KR)

(72) Inventor: Kwanghyun Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 16/230,455

(22) Filed: Dec. 21, 2018

(65) Prior Publication Data

US 2019/0293340 A1 Sep. 26, 2019

(30) Foreign Application Priority Data

Mar. 26, 2018 (KR) ..... 10-2018-0034718

(51) Int. Cl.

| | |
|---|---|
| ***F25D 25/02*** | (2006.01) |
| ***A47B 51/00*** | (2006.01) |
| ***F25D 23/02*** | (2006.01) |
| ***F25D 25/00*** | (2006.01) |
| *F25D 25/04* | (2006.01) |

(52) U.S. Cl.

CPC ..... *F25D 25/025* (2013.01); *F25D 25/022* (2013.01); *A47B 51/00* (2013.01); *F25D 23/021* (2013.01); *F25D 25/005* (2013.01); *F25D 25/04* (2013.01)

(58) Field of Classification Search

CPC .... F25D 25/005; F25D 25/022; F25D 25/025; F25D 25/04; F25D 23/021; A47B 51/00

See application file for complete search history.

(56) References Cited

U.S. PATENT DOCUMENTS

| | | | | |
|---|---|---|---|---|
| 911,843 | A * | 2/1909 | Sample | F25D 3/04 62/379 |
| 6,733,094 | B1 * | 5/2004 | Chang | A47B 21/0073 312/306 |
| 7,600,833 | B2 * | 10/2009 | Oh | A47B 51/00 312/404 |
| 8,827,390 | B2 * | 9/2014 | Wehner | F25D 23/028 312/405.1 |
| 9,107,494 | B2 * | 8/2015 | Scheuring | A47B 51/00 |
| 2006/0021373 | A1 * | 2/2006 | Oh | F25D 25/025 62/407 |

(Continued)

FOREIGN PATENT DOCUMENTS

| | | | | |
|---|---|---|---|---|
| DE | 29716164 | U1 * | 11/1997 | A47B 51/00 |
| EP | 2752632 | A2 * | 7/2014 | F25D 17/065 |

(Continued)

*Primary Examiner* — Andrew M Roersma

(74) *Attorney, Agent, or Firm* — Fish & Richardson P.C.

(57) ABSTRACT

A refrigerator includes a cabinet that defines a lower storage space, a front panel door part configured to open and close the lower storage space, a drawer part connected to the front panel door part, a support member located at the drawer part, and an elevation assembly located at the front panel door part and configured to elevate the support member relative to the drawer part. The elevation assembly includes at least one elevation member that extends from the front panel door part to the drawer part and that passes through the drawer part, and a driving device that is located in the front panel door part, that is configured to provide power to the at least one elevation member, and that is configured to cause a vertical movement of the at least one elevation member relative to the drawer part.

18 Claims, 24 Drawing Sheets

(56) References Cited

U.S. PATENT DOCUMENTS

| | | | | |
|---|---|---|---|---|
| 2014/0265798 | A1* | 9/2014 | Watts | F25D 23/04<br>312/404 |
| 2015/0059399 | A1* | 3/2015 | Hwang | F25D 25/025<br>62/441 |
| 2018/0128540 | A1* | 5/2018 | Yasaka | B66D 1/12 |
| 2018/0259246 | A1* | 9/2018 | Choi | F25D 25/025 |

FOREIGN PATENT DOCUMENTS

| | | | | |
|---|---|---|---|---|
| JP | H-05296647 | A * | 11/1993 | F25D 25/025 |
| KR | 10-2006-0006321 | | 1/2006 | |
| WO | WO-2010021091 | A1 * | 2/2010 | F25D 25/025 |

* cited by examiner

REFRIGERATOR

CROSS-REFERENCE TO RELATED APPLICATIONS

The present application claims priority under 35 U.S.C. 119 and 35 U.S.C. 365 to Korean Patent Application No. 10-2018-0034718, filed on Mar. 26, 2018, which is hereby incorporated by reference in its entirety.

BACKGROUND

The present disclosure relates to a refrigerator.

In general, refrigerators are home appliances for storing foods at a low temperature in a storage space that is covered by a door. For this, refrigerators cool the inside of the storage space by using cool air generated by being heat-exchanged with a refrigerant circulated through a refrigeration cycle to store foods in an optimum state.

In recent years, refrigerators have become increasingly multi-functional with changes of dietary lives and gentrification of products, and refrigerators having various structures and convenience devices for convenience of users and for efficient use of internal spaces have been released.

The storage space of the refrigerator may be opened/closed by the door. Also, refrigerators may be classified into various types according to an arranged configuration of the storage space and a structure of the door for opening and closing the storage space.

The refrigerator door may be classified into a rotation-type door that opens and closes a storage space through rotation thereof and a drawer door that is inserted and withdrawn in a drawer type.

Also, the drawer door is often disposed in a lower region of the refrigerator. Thus, when the drawer-type door is disposed in the lower region of the refrigerator, a user has to turn its back to take out a basket or foods in the drawer door. If the basket or the foods are heavy, the user may feel inconvenient to use the basket or may be injured.

In order to solve such a limitation, various structures are being developed in which the drawer door is capable of being elevated.

Representatively, a structure in which a plurality of elevation rails and an elevation frame on which a basket is placed are provided on a rear surface of a draw-out door, and the basket is elevated by driving of a motor and a driving arm is closed in Koran Patent Publication No. 10-2006-0006321.

However, in such a structure, since the entire basket is elevated, when the basket is elevated, stability may be deteriorated. If a left and right balance is not balanced, the elevation operation may not be performed properly, or the basket may be damaged.

Also, in order to elevate the basket, the entire basket have to be withdrawn to the outside of the refrigerator. In the structure in which the entire basket is withdrawn, the rail structure connecting the door and the refrigerator body may be unstable, and durability may be deteriorated. Particularly, this limitation may occur more severely when heavy components are concentrated on the door for the elevation.

Also, the structure for elevating the basket may be exposed to both the rear surface of the door and the lower side of the basket, thereby causing a limitation in safety of the user when the door is inserted and withdrawn or elevated.

SUMMARY

Embodiments provide a refrigerator in which a portion within a drawer door, which is withdrawn in a drawer type, is elevated to improve user's convenience in use.

Embodiments also provide a refrigerator in which all electrical devices providing power for elevation are provided in a front panel door part of a drawer door, and the front panel door part and the drawer part are separable to improve safety and serviceability.

Embodiments also provide a refrigerator in which an elevatable support member is disposed in a drawer part, and an elevation assembly provided in a door operates to elevate the support member within the drawer part.

Embodiments also provide a refrigerator in which a support member within a drawer part is elevated in a state in which a portion of a front part of an entire drawer part is withdrawn to the outside of a cabinet, and a portion of a rear part is disposed in the cabinet.

Embodiments also provide a refrigerator in which a path of an elevation member that is inserted into a drawer part and elevated is covered to improve an outer appearance and operation reliability.

Embodiments also provide a refrigerator in which an elevation assembly that is capable of covering a portion of a drawer door is prevented from being exposed.

Embodiments also provide a refrigerator in which an elevation member of an elevation assembly is easily separated according to whether an elevation function is used to improve convenience in use and space utilization.

According to one aspect of the subject matter described in this application, a refrigerator includes: a cabinet that defines an upper storage space and a lower storage space; a front panel door part configured to open and close at least a portion of the lower storage space; a drawer part connected to the front panel door part and configured to insert into and withdraw from the lower storage space together with the front panel door part; a support member located at the drawer part and configured to seat an object stored in the drawer part; and an elevation assembly located at the front panel door part and configured to elevate the support member relative to the drawer part. The elevation assembly includes: at least one elevation member that extends from the front panel door part to the drawer part, that is configured to pass through at least a portion of the drawer part, and that is located vertically below the support member, with the at least one elevation member being configured to support the support member; and a driving device that is located in the front panel door part, that is configured to provide power to the at least one elevation member, and that is configured to cause a vertical movement of the at least one elevation member relative to the drawer part.

Implementations according to this aspect may include one or more of the following features. For example, the drawer part may define: a front space disposed forward in a direction in which the drawer part is configured to withdraw from the lower storage space of the cabinet; and a rear space disposed rearward of the front space, where the support member is arranged in the front space. In some examples, the at least one elevation member is configured to pass through a front surface of the drawer part and to extend to an inside of the front space of the drawer part.

In some examples, the elevation assembly is configured to perform the vertical movement of the at least one elevation member in a state in which the front space of the drawer part is completely exposed to an outside of the cabinet. In some implementations, the drawer part includes a drawer cover configured to partition an inner space of the drawer part into the front space and the rear space, with the drawer cover being configured to cover the rear space.

In some implementations, the at least one elevation member includes a pair of elevation members spaced apart from each other in a lateral direction, where the drawer part defines a pair of openings at a front surface of the drawer part at positions corresponding to the pair of elevation members, the pair of openings extending in a vertical direction to allow the vertical movement of the pair of elevation members. In some implementations, the front panel door part defines a recessed space at a rear surface of the front panel door part, with the recessed space being configured to accommodate the elevation assembly therein, where a front surface of the drawer part is configured to cover at least a portion of the elevation assembly.

In some implementations, the elevation assembly further includes: a frame configured to be fixed to a rear surface of the front panel door part, with the frame defining a frame space configured to accommodate the driving device therein; a pair of elevation shafts respectively located at sides of the frame space and configured to be rotated by the driving device; and an elevation block that defines openings respectively penetrated by the pair of elevation shafts, that defines a screw thread at each of openings of the elevation block, and that is configured to move in a vertical direction along the pair of elevation shafts based on rotation of the pair of elevation shafts. The at least one elevation member may be coupled to the elevation block.

In some examples, the driving device includes: an elevation motor located between the pair of elevation shafts; and a gear assembly including a plurality of gears that are configured to connect the elevation motor to the pair of elevation shafts and that allow the pair of elevation shafts to simultaneously rotate at a same rotation rate. In some examples, the elevation motor is located at a bottom surface of an inside of the frame, the elevation motor including a rotation shaft that passes through the frame, where the gear assembly is arranged at a bottom surface of an outside of the frame and connected to the rotation shaft of the elevation motor.

In some examples, the elevation block defines a motor groove recessed from a surface of the elevation block and configured to receive the elevation motor based on the elevation block moving downward in the vertical direction along the pair of elevation shafts. In some examples, the refrigerator further includes at least one guide device located at a front surface of the drawer part, where the at least one guide device defines at least one guide opening configured to receive the at least one elevation member and to guide the vertical movement of the at least one elevation member in a state in which the elevation member passes through the at least one guide opening.

In some implementations, each of the at least one guide device includes: a guide frame located in a drawer opening defined at the front surface of the drawer part, the guide frame defining the guide opening; a plurality of shutters that are arranged in the guide opening in a vertical direction and that are configured to cover the guide opening; and a shutter guide part located at each of both left and right surfaces of the guide opening and configured to guide the plurality of shutters to move up and down along the vertical direction. The at least one elevation member may be configured to: pass through the at least one guide opening from a lower side of the plurality of shutters; and based on the at least one elevation member moving in an upward direction, push the lower side of the plurality of shutters in the upward direction to allow the plurality of shutters to move in the upward direction. The plurality of shutters may be configured to move in a downward direction by a weight of the plurality of shutters based on the at least one elevation member moving in the downward direction.

In some examples, the shutter guide part includes a plurality of guides that extend in the vertical direction, that define recesses configured to accommodate ends of the plurality of shutters, and that define a moving path of the plurality of shutters, where a number of the plurality of guides correspond to a number of the plurality of shutters. In these examples, at least portions of the plurality of guides are spaced apart from each other in a front-rear direction, and the plurality of shutters are configured to overlap each other in the front-rear direction based on the plurality of shutters moving upward.

In some implementations, the each of the at least one guide device further includes a cover part located vertically above the guide opening and configured to cover all of the plurality of shutters that overlap each other in a state in which the plurality of shutters have moved upward, where each of the plurality of guides of the shutter guide part extends from a front side of the cover part to an upper end of the cover part.

In some examples, each of the plurality of shutters includes: upper protrusions that protrude laterally outward from upper ends of both sides of the shutter; and lower protrusions that protrude laterally outward from lower ends of both sides of the shutter. In these examples, each of the plurality of guides of the shutter guide part includes: upper grooves configured to receive the upper protrusions of the shutter, respectively, with the upper grooves extending in an inclined direction with respect to the vertical direction, and lower grooves configured to receive the lower protrusions of the shutter, respectively, with the lower grooves extending in the inclined direction. In these examples, outer surfaces of the plurality of shutters may be configured to define one plane in a state in which the plurality of shutters are positioned at a lowermost position based on the upper protrusions being inserted into the upper grooves and the lower protrusions being inserted into the lower grooves.

In some implementations, the guide opening is configured to be closed in the state in the plurality of shutters are positioned at the lowermost position, where an inner surface of the drawer part is on the one plane defined by the outer surfaces of the plurality of shutters in a state in which the guide opening is closed. In some examples, the plurality of shutters include: a lower shutter disposed at a lower side; and an upper shutter disposed at an upper side, where the lower shutter includes a shutter bent part that is bent from an upper end of the lower shutter and that is configured to seat a lower end of the upper shutter.

In some implementations, the drawer part includes a plurality of plates that define an inner surface of the drawer part, each of the plurality of plates being made of a metal material, where each of the plurality of shutters is made of the metal material. In some implementations, the support member has a plate shape and a size corresponding to an interior of the front space of the drawer part.

The details of one or more embodiments are set forth in the accompanying drawings and the description below. Other features will be apparent from the description and drawings, and from the claims.

DETAILED DESCRIPTION OF THE EMBODIMENTS

Hereinafter, detailed embodiments of the present disclosure will be described in detail with reference to the accompanying drawings. However, the scope of the present disclosure is not limited to proposed embodiments, and other regressive inventions or other embodiments included in the scope of the spirits of the present disclosure may be easily proposed through addition, change, deletion, and the like of other elements.

Figure 1:
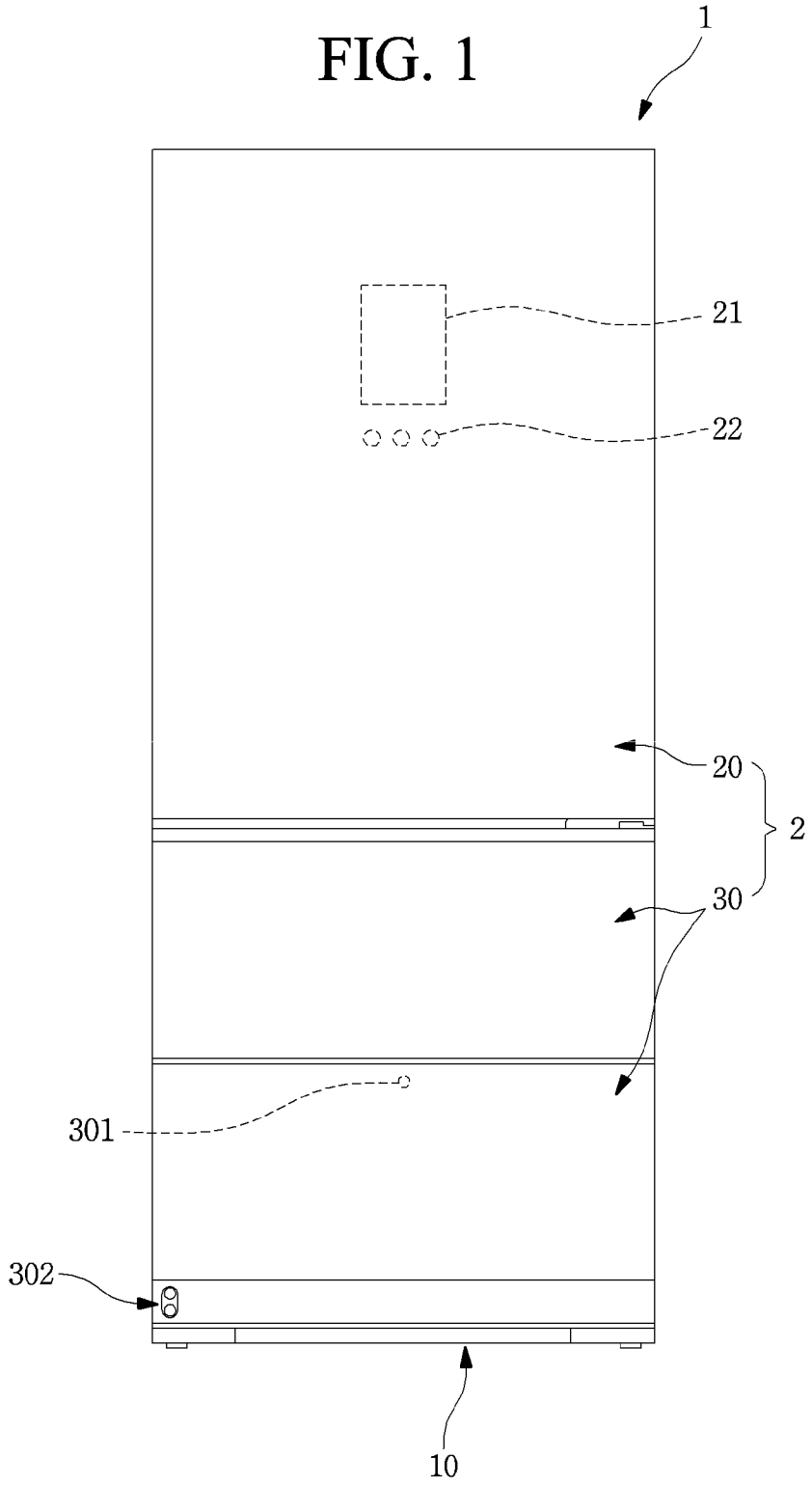
FIG. 1 is a front view of a refrigerator according to an embodiment.

FIG. 1 is a front view of a refrigerator according to an embodiment.

As illustrated in the drawing, the refrigerator 1 may have an outer appearance that is defined by a cabinet 10 defining a storage space and a door 2 covering an opened front surface of the cabinet 10.

The storage space within the storage space may be divided into a plurality of spaces. For example, an upper space of the cabinet 10 may be provided as a refrigerating compartment, and a lower space of the cabinet 10 may be provided as a freezing compartment. Each of the upper space and the lower space may be provided as an independent space that is maintained at a different temperature, except for the refrigerating compartment and the freezing compartment. The upper space and the lower space may be called an upper storage space and a lower storage space.

The door 2 may be constituted by a rotation door 20 opening and closing the upper storage space through rotation thereof and a drawer door 30 opening and closing the lower storage space by being inserted or withdrawn in a drawer type. The lower space may be vertically divided again. The drawer door 30 may be constituted by an upper drawer door 30 and a lower drawer door 30. Also, an outer appearance of each of the rotation door 20 and the drawer door 30 may be made of a metal material and be exposed to the front side.

Although the refrigerator in which all of the rotation door 20 and the drawer door 30 are provided is described, the present disclosure is not limited thereto. For example, the present disclosure may be applied to all refrigerators including a door that is inserted and withdrawn in the drawer type.

A display 21 may be disposed on one side of a front surface of the rotation door 20. The display 21 may have a liquid crystal display structure or a multi-segment display such as a seven-segment display or an "88" shape segment structure. Also, when the outer appearance of the door 2 is made of the metal material, a plurality of fine holes are punched in the display 21 to display information by using light passing therethrough.

Also, a manipulation part 22 that is capable of manipulating automatic rotation or withdrawal of the upper door 2 or the lower door 2 may be provided on one side of the rotation door 20. The manipulation part may be integrated with the display 21 and may operate in a touch manner or a button manner. The manipulation part 22 may input an overall operation of the refrigerator 1 and manipulate an insertion and withdrawal of the drawer door 30 or an elevation of a support member 35 within the drawer door.

A manipulation part 301 may also be provided on the drawer door 30. The manipulation part 301 may be disposed on one side of the drawer door 30 that is disposed at the lowermost portion of the drawer door 30. The manipulation part 301 may operate in a touch or button manner. The manipulation part 301 may be provided as a sensor detecting proximity or movement of a user or provided as an input unit that operates by a user's motion or voice.

As illustrated in the drawing, a manipulation device 302 may be disposed on a lower end of the lower drawer door 30 to illuminate an image on a bottom surface and thereby to output a virtual switch and to input an operation in such a manner that the user approaches a corresponding area.

The lower drawer door 30 may be automatically inserted and withdrawn according to the manipulation of the manipulation part 301. Also, a food or container within the lower drawer door 30 may be elevated in a state in which the drawer door 30 is withdrawn by the manipulation of the manipulation part 301.

That is, the automatic insertion and withdrawal and/or automatic elevation of the lower drawer door 30 may be performed by at least one of a plurality of manipulation devices 22, 301, and 302. As necessary, only one of the plurality of manipulation devices 22, 301, and 302 may be provided.

Hereinafter, the lower drawer door 30 will be described in more detail, and also, the lower drawer door 30 will be called a drawer door unless otherwise specified.

Figure 2:
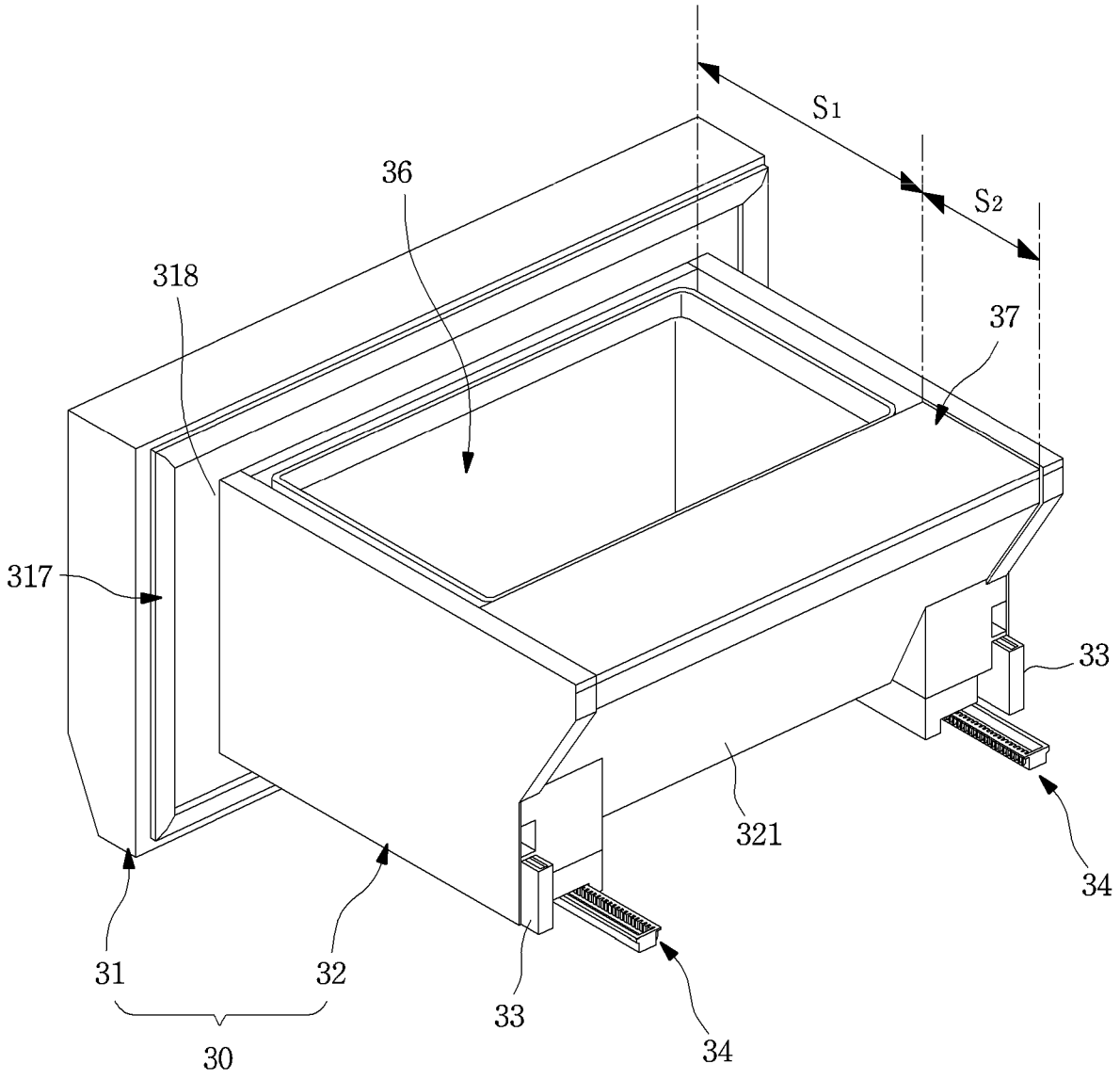
FIG. 2 is a perspective view illustrating a drawer door of the refrigerator according to an embodiment.
Figure 3:
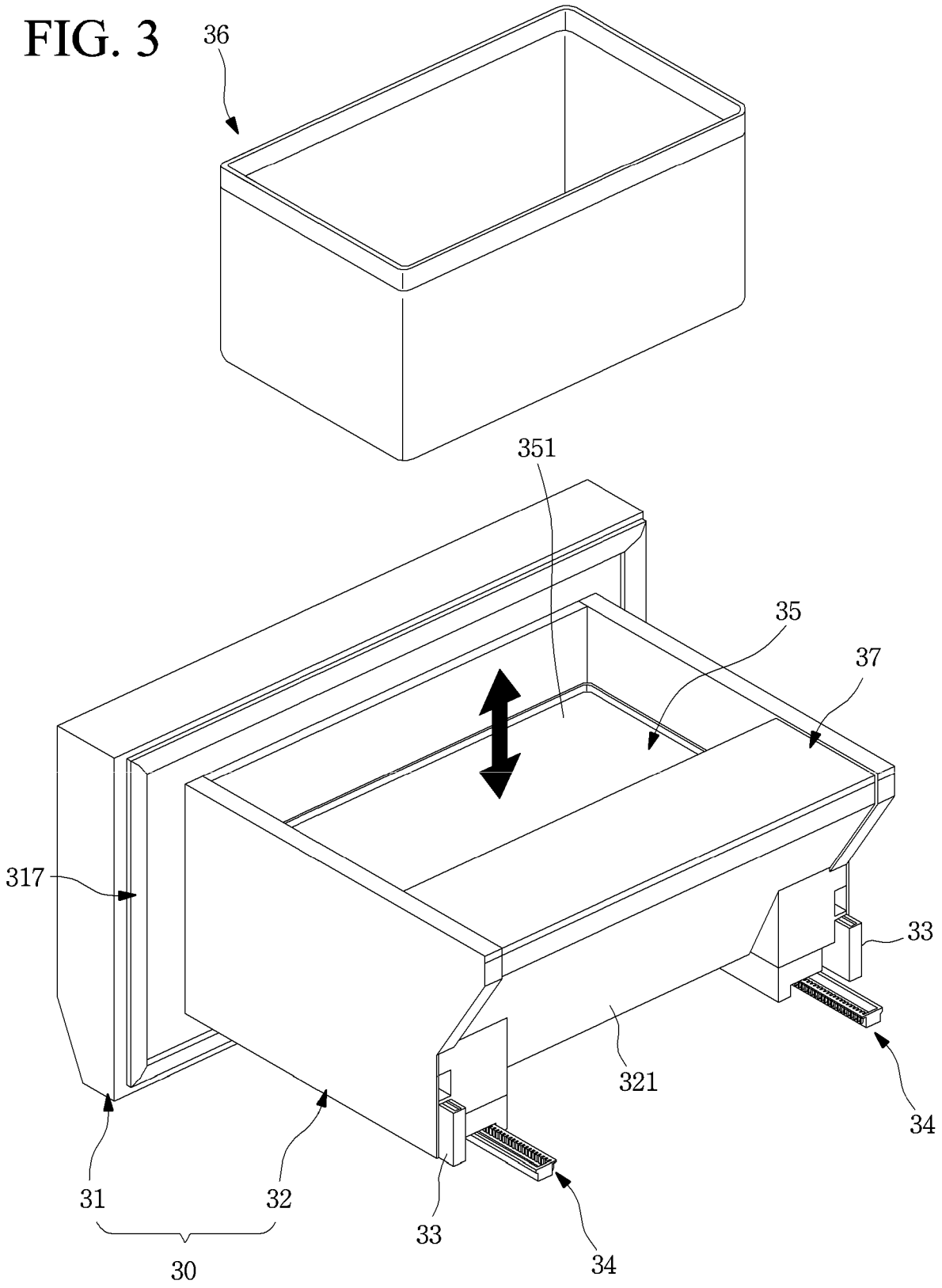
FIG. 3 is a perspective view illustrating a state in which a container of the drawer door is separated.

FIG. 2 is a perspective view of the drawer door according to an embodiment. Also, FIG. 3 is a perspective view illustrating a state in which the container of the drawer door is separated.

As illustrated in the drawings, the drawer door 30 may include a front panel door part 31 opening and closing the storage space and a drawer part 32 coupled to a rear surface of the front panel door part 31 and inserted and withdrawn together with the front panel door part 31.

The front panel door part 31 may be exposed to the outside of the cabinet 10 to define an outer appearance of the refrigerator 1, and the drawer part 32 may be disposed inside the cabinet 10 to define an storage space. Also, the front panel door part 31 and the drawer part 32 may be coupled to each other and inserted and withdrawn forward and backward together with each other.

The drawer part 32 may be disposed on the rear surface of the front panel door part 31 to define a space in which the food or container to be stored is accommodated. The inside of the drawer part 32 may have a box shape having an opened top surface.

The inner surface and the outer surface of the drawer part 32 may be defined by a plurality of plates made of a metal material. Each of the plurality of plates may be made of a metal material such as stainless steel. Thus, the outer appearance may be seen as being clean and luxurious, and the entire inside of the drawer part 32 may be uniformly cooled through heat transfer by surrounding cold air.

In the state in which the drawer door 30 is inserted, a machine room 3 in which a compressor and a condenser constituting a refrigeration cycle are provided may be disposed behind the drawer door 30. Thus, a rear end of the drawer part 32 may have a shape of which an upper end further protrudes from a lower end, and an inclined surface 321 may be provided on a rear surface of the drawer part 32.

Also, a draw-out rail 33 guiding the insertion and withdrawal of the drawer door 30 may be provided on each of both side surfaces of the drawer part 32. The drawer door 30 may be mounted to be inserted into or withdrawn from the cabinet 10 by the draw-out rail 33. The draw-out rail 33 may have a rail structure that is capable of extending in multi-stage.

Also, the draw-out rail 33 may be provided on a lower end of each of both the side surfaces of the drawer part 32. Thus, it may be understood that the draw-out rail 33 is disposed on the bottom surface of the drawer part 32. Thus, the draw-out rail 33 may be provided on the bottom surface of the drawer part 32 and called an under rail.

A draw-out rack 34 may be disposed on the bottom surface of the drawer part 32. The draw-out rack 34 may be disposed on each of both sides and be interlocked with an operation of a draw-out motor 14 mounted on the cabinet 10 to automatically insert and withdraw the drawer door 30. That is, when an operation is inputted into the manipulation parts 22 and 301, the draw-out motor (see reference numeral 14 of FIG. 17) may be driven to insert and withdraw the drawer door 30 according to movement of the draw-out rack 34. Here, the drawer door 30 may be stably inserted and withdrawn by the draw-out rail 33.

The draw-out rack 34 may not be provided on the drawer part 32. Here, the user may hold a side of the front panel door part 31 to push and pull the front panel door part 31 so that the drawer door 30 is directly inserted and withdrawn.

The inside of the drawer part 32 may be divided into a front space S1 and a rear space S2. The support member 35 that is vertically elevated and a container seated on the support member 35 to be elevated together with the support member 35 may be disposed in the front space S1. Although the container 36 is illustrated in the form of a basket having an opened upper portion, the container 36 may have a closed box structure such as a kimchi box. Also, a plurality of containers 36 may be stacked or arranged in parallel to each other.

Also, when the drawer door 30 is withdrawn, the entire drawer part 32 may not be withdrawn to the outside of the storage space due to a limitation in draw-out distance of the drawer door 30. That is, at least the front space S1 is withdrawn to the outside of the storage space, and the whole or a portion of the rear space S2 is disposed inside the storage space within the cabinet 10.

As the draw-out distance increases, the drawer door 30 may have large moment applied to the drawer door 30 in a draw-out state, which makes it difficult to maintain a stable state, and the draw-out rail 33 or the draw-out rack 34 may be deformed or damaged. Particularly, such a limitation may become more serious in a state in which additional devices for elevation are provided in the drawer door 30.

Thus, only the front space of the drawer part 32 that is necessary for elevating the support member 35 may be exposed to the outside of the cabinet 10 so that the drawer part 32 is withdrawn by a minimum distance at which the support member 35 is elevatable.

A support member 35 is accommodated in the front space S1 so that o that the food or the container 36 seated on the support member 35 is elevated together with the support member 35 is accommodated in the front member 35 while the support member 35 is elevated. The support member 35 may be a portion on which the food or container to be elevated is substantially seated and thus be called a seating member.

The support member 35 may be elevated by an elevation assembly 40 provided in the drawer door 30. The elevation assembly 40 for elevating the support member 35 may be mounted substantially on the front panel door part 31 and may not be exposed to the outside in the state in which the drawer door 30 is assembled. A more detailed structure of the elevation assembly 40 will be described below.

A separate drawer cover 37 may be provided in the rear space S2. The front space S1 and the rear space S2 may be partitioned by the drawer cover 37. In a state in which the drawer cover 37 is mounted, front and top surfaces of the rear space S2 may be covered and may not be used. However, when the drawer cover 37 is separated, the user may be accessible to the rear space S2, and thus, foods may be easily accommodated in the rear space S2. To utilize the rear space S2, a separate pocket or a container corresponding to the shape of the rear space may be disposed in the rear space S2.

Figure 4:
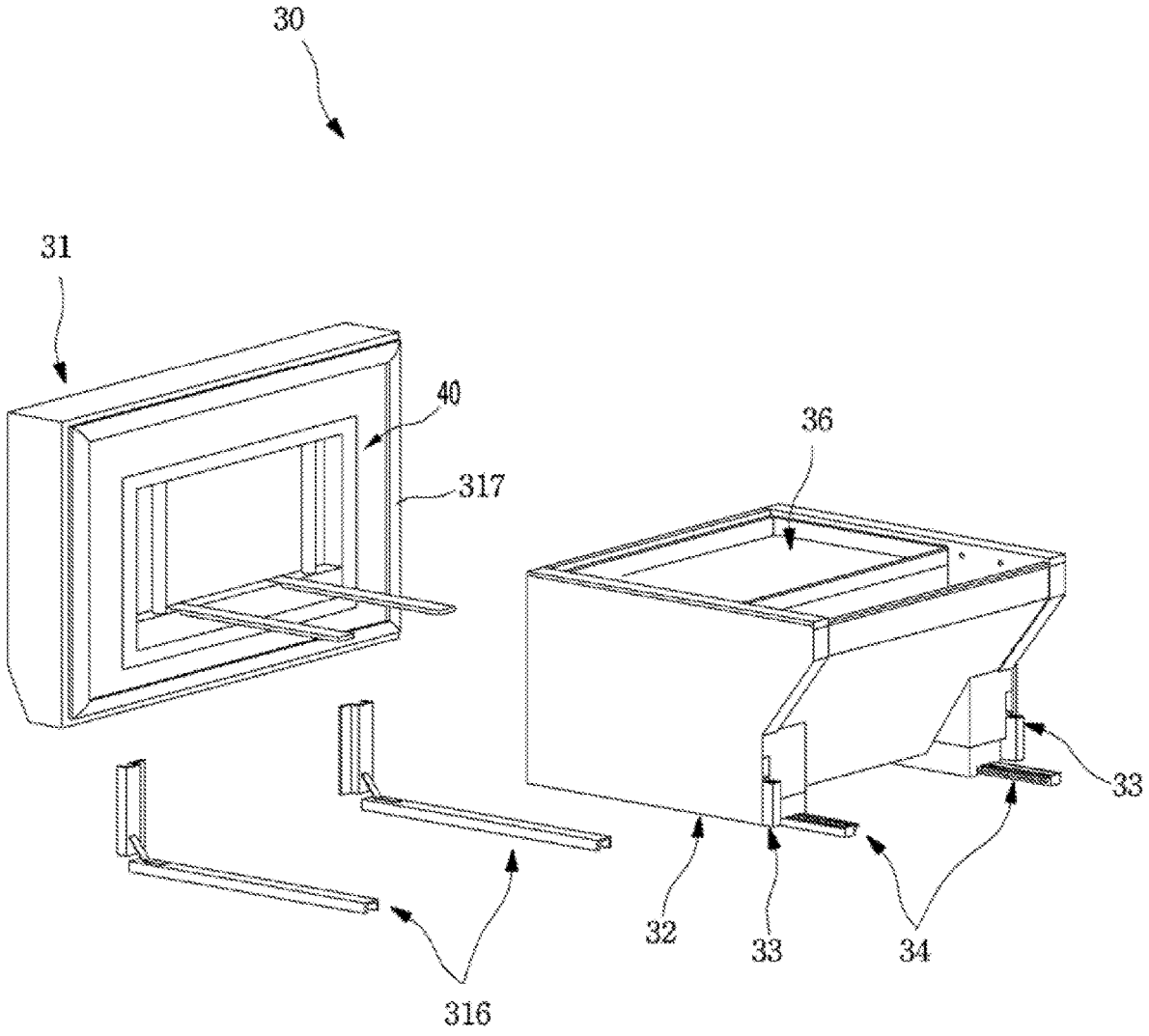
FIG. 4 is an exploded perspective view illustrating a state in which the drawer door is separated when viewed from a rear side.
Figure 5:
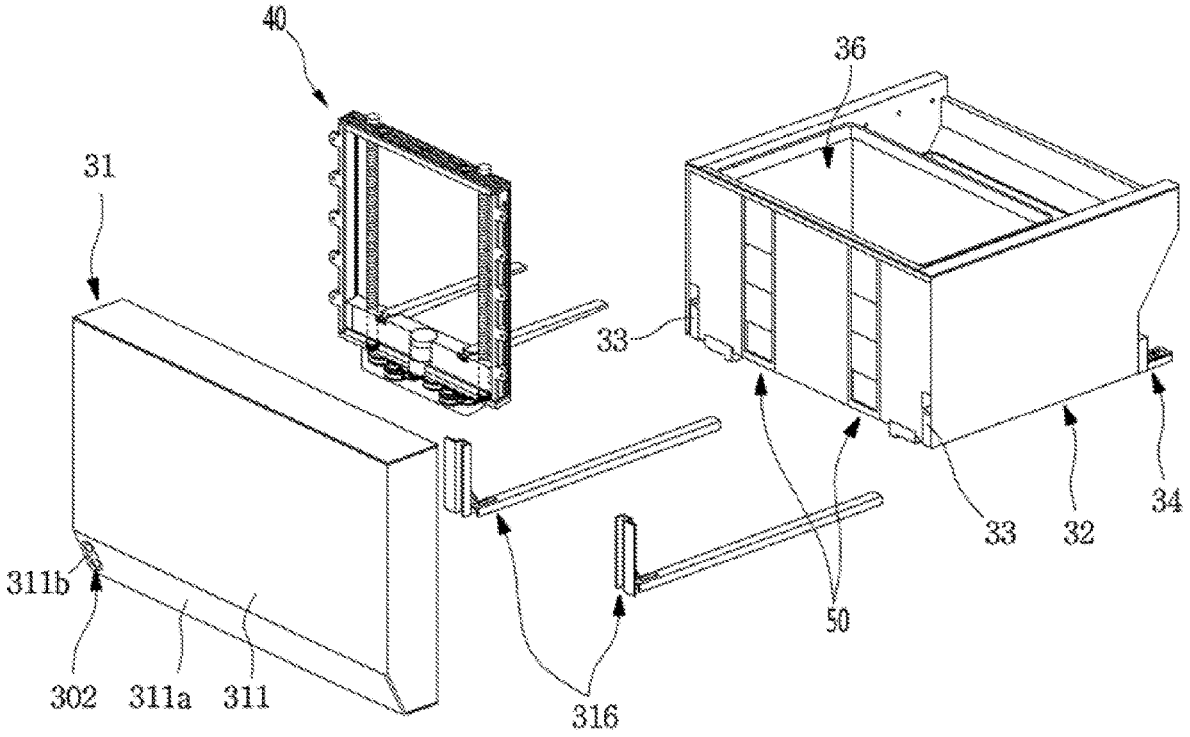
FIG. 5 is an exploded perspective view illustrating the state in which the drawer door is separated when viewed from a front side.

FIG. 4 is an exploded perspective view illustrating a state in which the drawer door is separated when viewed from a rear side. Also, FIG. 5 is an exploded perspective view illustrating the state in which the drawer door is separated when viewed from a front side.

As illustrated in the drawings, the front panel door part 31 and the drawer part 32 constituting the drawer door 30 may be coupled to be separated from each other. Thus, assembling workability and serviceability may be improved through the separable structure of the front panel door part 31 and the drawer part 32.

A rear surface of the front panel door part 31 and a front surface of the drawer part 32 may be coupled to each other. The elevation assembly disposed on a rear surface of the front panel door part 31 may be configured to be covered by the coupling of the drawer part 32. The elevation assembly 40 may be separated or coupled to the front panel door part 31 when the front panel door part 31 and the drawer part 32 are separated from or coupled to each other. Particularly, all the electrical devices including the elevation assembly 40 for providing power for elevating the support member 35 may be disposed in the front panel door part. Thus, the drawer part 32 and the front panel door part 31 may be separated from each other to clean the inside of the drawer part 32 or to maintain the elevation assembly 40. The drawer part 32 and the front panel door part 31 may be separated from each other, the inside of the drawer part 32 may be cleaned more safely, and the maintenance of the elevation assembly 40 may be easily performed.

The outer appearance of the front panel door part 31 may be defined by an outer case 311 defining a front surface and a portion of a circumferential surface and a door liner 318 defining a rear surface. Also, the inside of the front panel door part 31 may be filled with a heat insulating material, and a space through which at least a portion of the elevation assembly 40 is mounted may be provided.

The outer case 311 may be formed by bending a plate-shaped metal material, and an inclined part 311*a* may be provided on a lower end of a front surface of the outer case 311. A manipulation device hole 311*b* is defined in one side of the inclined part 311*a*, and the manipulation device 302 for detecting an output of a virtual switch and user's manipulation may be mounted in the manipulation device hole 311*b*. The manipulation device 302 may be constituted by a projector light that outputs an image and a proximity sensor. Also, a manipulation part bracket for the mounting of the manipulation device 302 and an arrangement of a line connected to electrical components within the front panel door part 31 may be provided in the lower deco 313.

The door liner 318 may be made of a plastic material through injection molding and may have a space recessed in a corresponding shape so that the elevation assembly 40 is mounted. That is, the elevation assembly 40 may be configured so as not to interfere with the drawer part 32 when the front panel door part 31 and the drawer part 32 are coupled to each other in the state in which the front panel door part 31 is mounted in the recessed space.

In detail, all of the components mounted on the frame 41 in addition to the frame 41 of the elevation assembly 40 may be inserted into the space recessed in the rear surface of the front panel door part 31, and only the elevation member 45 for supporting the support member 35 may extend to pass through the drawer part 32 and be disposed in the front space inside the drawer part 32. Here, the rest constituents of the elevation assembly 40 mounted to the front panel door part 31 except for the elevation member 45 may be disposed on the same plane as the rear surface of the front panel door part 31 or inside the front panel door part 31 so as to be prevented from interfering with the drawer part 32. The front panel door part 31 may further include a separate cover for covering exposure of the elevation assembly 40 in the state in which the elevation assembly 40 is mounted.

A door gasket 317 may be provided around the rear surface of the front panel door part 31. The door gasket 317 contacts the front end of the cabinet 10 when the drawer door 30 is closed so that the inside of the drawer door 30 is sealed.

A pair of door frames 316 may be disposed on both left and right sides on the rear surface of the front panel door part 31. The door frames 316 may connect the front panel door part 31 to the drawer part 32 so that the drawer part 32 is maintained in the state of being coupled to the front panel door part 31. Thus, the front panel door part 31 and the drawer part 32 may be inserted and withdrawn together in the state of being coupled to each other.

The drawer part 32 may be coupled to the rear surface of the front panel door part 31, and the front surface of the drawer part 32 may cover the elevation assembly 40 mounted on the front panel door part 31. The drawer part 32 may have an opened top surface, and the container and the support member 35 may be disposed in the front space S1 inside the drawer part 32. The door cover 37 may be provided in the rear space S2.

The front surface of the drawer part 32 contacts the rear surface of the front panel door part 31 and the elevation assembly 40. Also, a guide device 50 through which the elevation member 45 of the elevation assembly 40 passes may be provided on the front surface of the drawer part 32.

The guide device 50 may be disposed on each of both left and right sides of the front surface of the drawer part 32 and may have a size corresponding to a corresponding position so as to be penetrated by the elevation member 45. Also, the guide device 50 may have a length corresponding to at least a stroke of the elevation member 45 for guiding the elevation member 45 that moves vertically. A structure of the guide device 50 will be described below in more detail.

Figure 6:
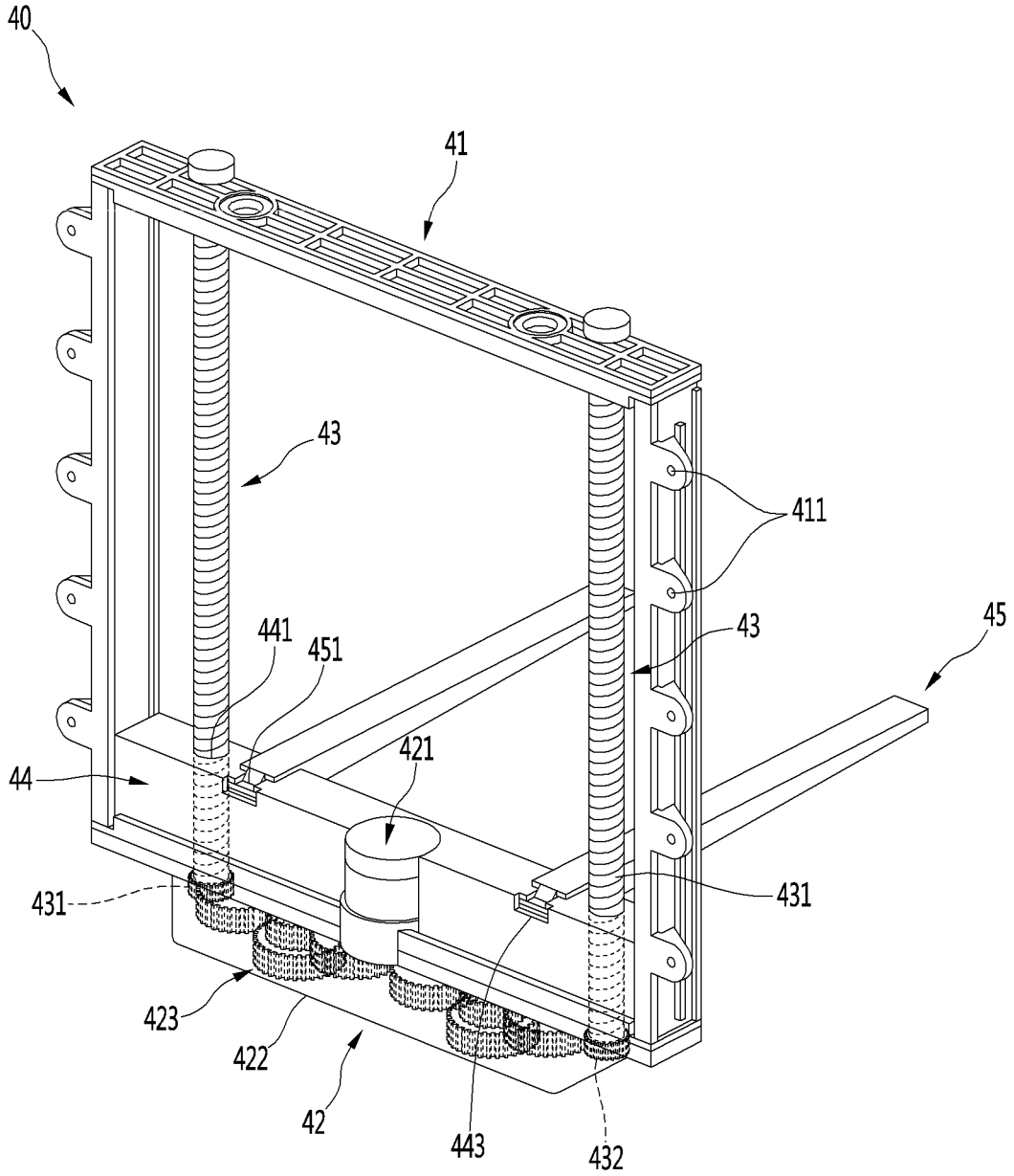
FIG. 6 is a perspective view of an elevation assembly according to an embodiment.
Figure 7:
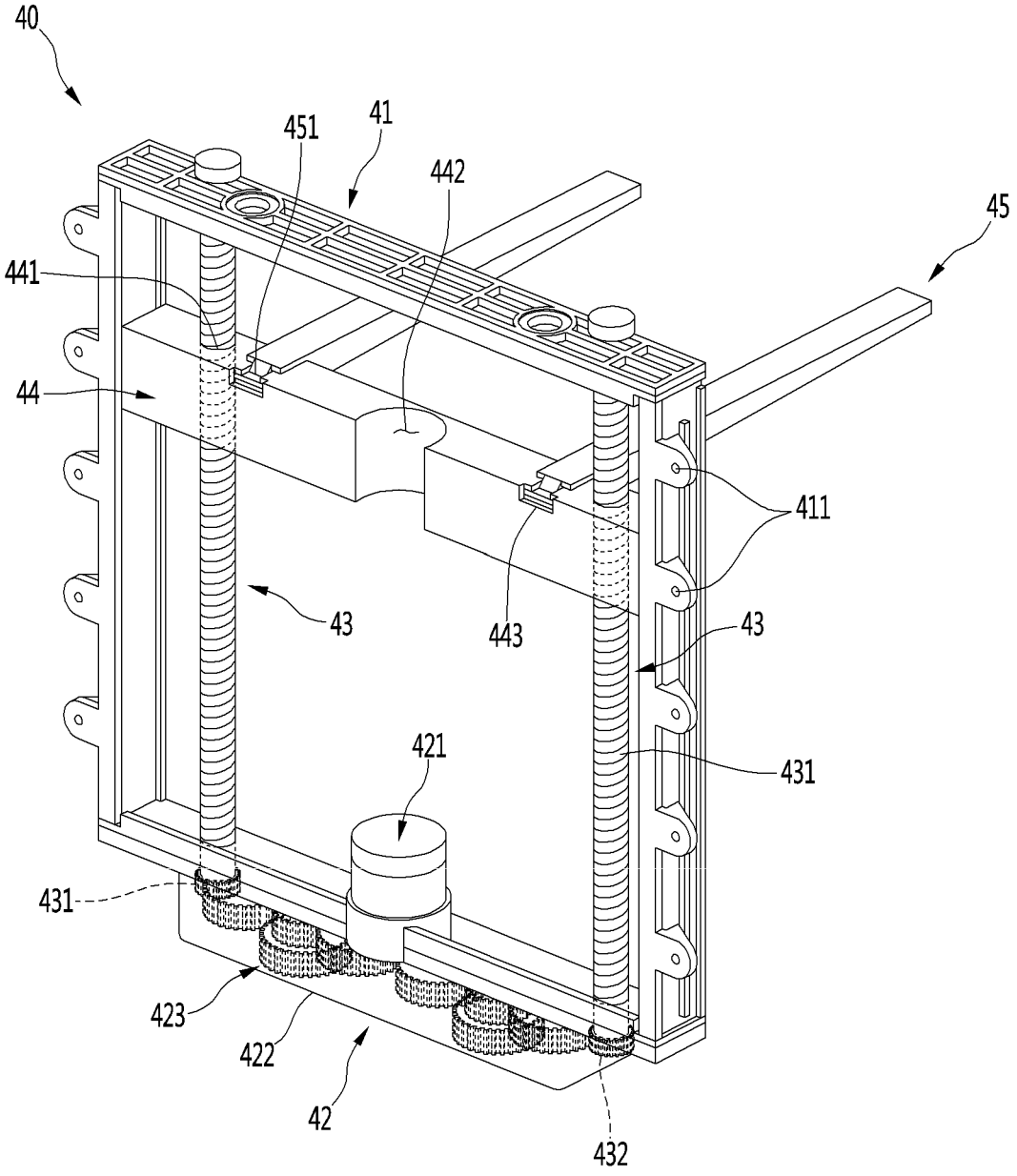
FIG. 7 is a perspective view illustrating a state in which the elevation assembly ascends.

FIG. 6 is a perspective view of the elevation assembly according to an embodiment. Also, FIG. 7 is a perspective view illustrating a state in which the elevation assembly ascends.

As illustrated in the drawings, the elevation assembly 40 may include a frame 41, a driving device 42, an elevation shaft 43, an elevation block 44, and an elevation member 45.

The frame 41 may have a rectangular frame shape, and a plurality of frame mounting parts 411 may be disposed around the frame 41. Also, a coupling member such as a screw may be coupled to each of the frame mounting parts 411 so that the frame 41 is fixedly mounted on the rear surface of the front panel door part 31.

Also, the elevation shaft 43 may be provided on both left and right sides of the opened inside of the frame 41. Upper and lower ends of the elevation shaft 43 may be rotatably fixed to the frame 41. A screw thread 431 may be formed on an outer surface of the elevation shaft 43. Thus, the elevation block 44 may vertically move along the elevation shaft 43 when the elevation shaft 43 rotates.

The driving device 42 may be provided on a bottom surface of the frame 41. The driving device 42 includes an elevation motor 421 for providing power for rotation of the elevation shaft 43, a plurality of gear assemblies 423 rotating by the elevation motor 421, and a gear case 422 that accommodates the gear assemblies 423.

In detail, the elevation motor 421 may be disposed at a center of the bottom surface of the frame 41 and may be disposed on the opened inner side of the frame 41. Also, the rotation shaft of the elevation motor 421 may be coupled to the gear on the gear case 422 by passing through the bottom surface of the frame 41. The elevation motor 421 may be accommodated in a separate motor case, and the motor case may be integrated with the gear case 422.

The gear case 422 may be mounted outside the bottom surface of the frame 41. The plurality of gears constituting the gear assembly 423 may be coupled to the inside of the gear case 422 and may be coupled to the rotation shaft of the elevation motor 421 disposed at the center.

Also, the gear assembly 423 provided in the gear case 422 may be configured to transmit the rotation of the elevation motor to the elevation shaft. Here, the gear assembly 423 may transmit the rotation of the elevation motor 421 disposed at the center to the elevation shaft 43 disposed on each of both the sides by the same size so that the elevation block 44 is not inclined or eccentric, and thus, both sides may vertically move in a horizontal state.

For this, the plurality of gears of the gear assembly 423 may be adjusted in number, size, and gear ratio so that the rotation force having the same magnitude and direction is transmitted to the elevation motor 421 when the elevation motor 421 rotates. Alternatively, when the directions of the screw threads of the elevation shaft 43 itself are reversed, the arrangement of the gears in the gear case 422 may be changed accordingly.

The elevation block 44 may be provided on the inner side of the frame 41 and may be configured to pass through the elevation shaft 43 disposed on both sides of the frame 41. The elevation block 44 may have a length that is enough to be accommodated inside the frame 41 and simultaneously to allow the pair of elevation shafts 43 to pass therethrough.

For this, a shaft hole 441 may be defined in each of both sides of the elevation block 44. The shaft hole 441 may be defined to pass through the elevation block 44 in the vertical direction so that the elevation shaft passes therethrough. Also, a screw thread corresponding to the screw thread 431 of the elevation shaft may be disposed on an inner surface of the shaft hole 441. When the elevation shaft 43 rotate, the elevation block 44 vertically moves along the elevation shaft 43.

Also, a motor groove 442 may be defined in the center of the elevation block 44. The motor groove 442 may be recessed in a shape corresponding to the shape of the elevation motor 421 so that the elevation block 44 is prevented from interfering by the elevation motor 421 even when the elevation block 44 vertically moves. The elevation motor 421 may be disposed inside the frame 41 by the motor groove 442 so as not to affect the elevation of the elevation block 44. Thus, the elevation assembly 40 may be compact in size and configured to be mounted within the front panel door part 31.

Also, an elevation member mounting part 443 may be further disposed on each of both sides of the elevation block 44. The elevation member mounting part 443 is for mounting the elevation member 45 and may be recessed in a top surface and front surface of the elevation block 44. The elevation member 45 may have a shape corresponding to an elevation member coupling part 451 disposed at a rear end of the elevation member 45. That is, the elevation member mounting part 443 and the elevation member coupling part 451 may have corresponding protrusion and groove shapes so that the elevation member 45 is easily detached through the vertical movement thereof, and in the state in which the elevation member 45 is mounted, the rigid fixed state may be maintained.

The elevation member 45 may be seated from an upper side to a lower side of the elevation block 44 and may be detached from the elevation block 44 when the elevation member 45 is lifted upward. Thus, if the elevation function is not required for the drawer part 32, the elevation member 45 may be separated to secure a space inside the drawer part 32. In order to use the elevation function for the drawer part 32, only the elevation member 45 may be easily separated without separating the entire elevation assembly 40.

The elevation member 45 may be mounted on the elevation block 44 to extend backward. A width of the elevation member 45 may be smaller than that of the guide hole 511 of the guide device 50. Thus, the elevation member 45 may be detached through the guide hole 511 or may vertically move along the guide hole 511.

Also, the pair of elevation members 45 may extend backward and be disposed inside the front space S1 inside the drawer part 32. And, the elevation member 45 may extend to the rear end of the support member 35 so as to support the support member 35 from the lower side.

Figure 8:
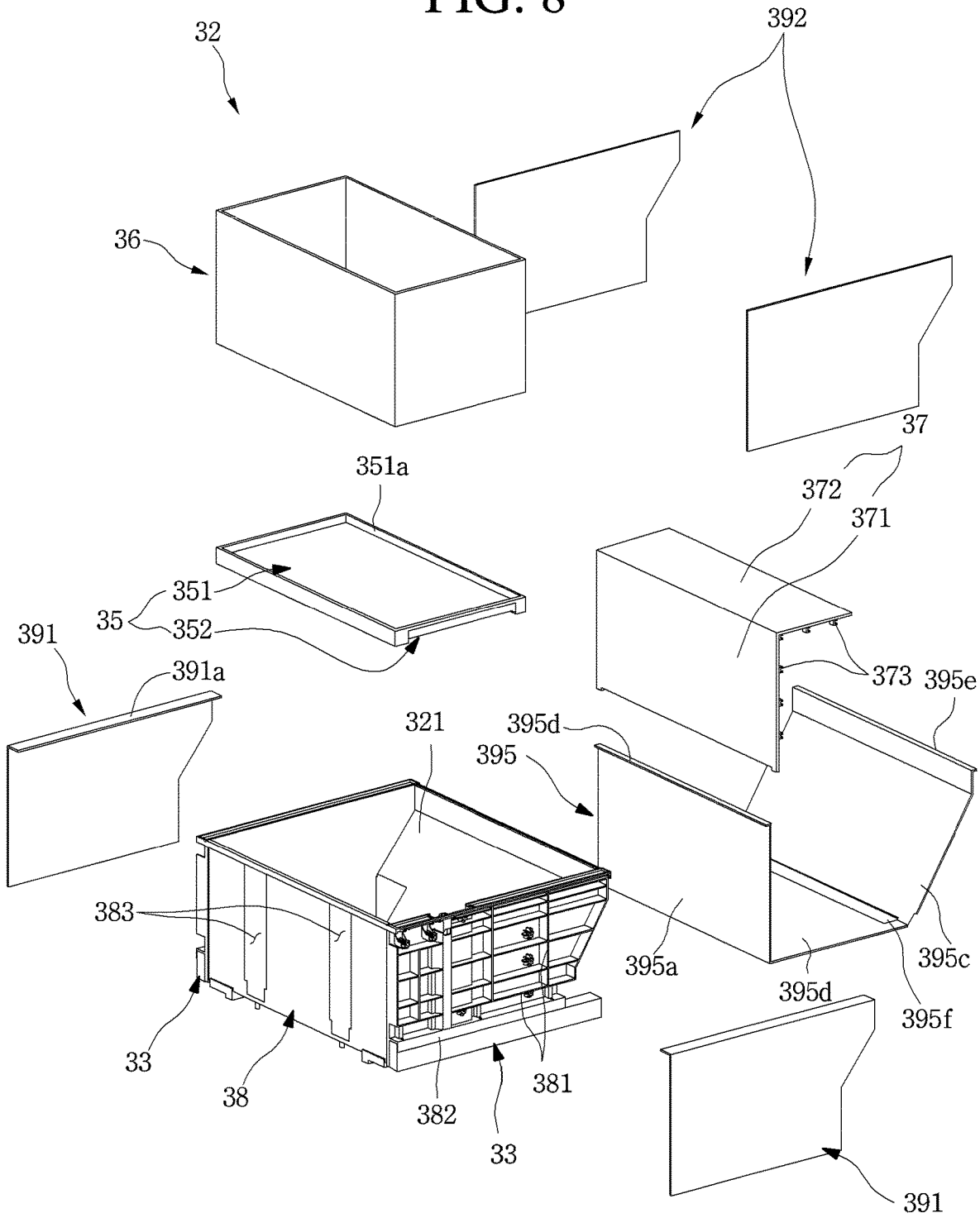
FIG. 8 is an exploded perspective view of a drawer part.

FIG. 8 is an exploded perspective view of the drawer part.

As illustrated in the drawings, the drawer part 32 may include a drawer body 38 defining an entire shape of the drawer part 32, the guide device 50 disposed on the front surface of the drawer part, and a plurality of plates 391, 392, and 393 defining an outer appearance of the drawer part 32.

In more detail, the drawer body 38 may be injection-molded by using a plastic material and define an entire shape of the drawer part 32. The drawer body 38 may have a basket shape having an opened top surface to define a food storage space therein. An inclined surface 321 may be disposed on a rear surface of the drawer body 38. Thus, an interference with the machine room 3 may not occur.

The door frames 316 may be mounted on both sides of the drawer part 32. The door frame 316 may be coupled to a lower portion of each of both sides of the bottom surface or both left and right surfaces of the drawer part 32. The drawer part 32 and the front panel door part 31 may be integrally coupled to each other and be inserted and withdrawn together with each other.

The draw-out rack 34 may be disposed on each of both the sides of the bottom surface of the drawer part 32. The drawer part 32 may be inserted and withdrawn forward and backward by the draw-out rack 34. In detail, in the state in which the drawer part 32 is mounted on the cabinet 10, at least a portion is disposed in the storage space. Also, the draw-out rack 34 may be coupled to a pinion gear 141 disposed on the bottom surface of the storage space. Thus, when the draw-out motor 14 is driven, the pinion gear 141 may rotate to allow the draw-out rack 34 to move, and the drawer door 30 may be inserted and withdrawn.

The drawer door 30 may not be automatically inserted and withdrawn. That is, the user may push or pull the drawer door 30 to be inserted and withdrawn. Here, the draw-out rack 34 may be omitted, and thus, the insertion and withdrawal may be performed through only the draw-out rail 33.

A plurality of reinforcement ribs 381 may extend in vertical and horizontal directions on both left and right sides of the drawer body 38. The reinforcement ribs 381 may prevent the drawer body 38 from being deformed by a load applied to both the left and right surfaces of the drawer body.

A rail mounting part 382 on which the draw-out rail 33 for guiding the insertion and withdrawal of the drawer body 38 is mounted may be disposed on a lower portion of each of both the side surfaces of the drawer body 38. The rail mounting part 382 may extend from a front end to a rear end and provide a space in which the draw-out rail 33 is accommodated. The draw-out rail 33 may be a rail that extends in multistage. The draw-out rail 33 may have one end fixed to the storage space inside the cabinet 10 and the other end fixed to the rail mounting part 382 to more stably realize insertion and the withdrawal of the drawer door 30.

The plurality of plates 391, 392, and 393 made of a plate-shaped metal material such as stainless steel to define at least portions of the inside and outside of the drawer body 38 may be provided on the drawer body 38.

In detail, the outer side plate 391 may be disposed on each of both left and right surfaces of the outside of the drawer body 38. The outer side plate 391 may be mounted on each of both the left and right surfaces of the drawer body 38 to define an outer appearance of each of both the side surfaces. Particularly, the constituents such as the power transmission member 52 and the draw-out rail 33, which are mounted on both the sides of the drawer body 38 may not be exposed to the outside.

An inner side plate 392 may be disposed on each of both left and right surfaces of the inside of the drawer body 38. The inner side plate 392 may be mounted on each of both the side surfaces of the drawer body 38 to define both the left and right surfaces of the inside thereof.

The extending end of the upper bent part 391*a* bent at the upper end of the outer side plate 391 may contact the upper end of the inner side plate 391. Thus, all of both side surfaces, inner and outer side surfaces, and a top surface of the drawer body 38 may be covered by the inner side plate 392 and the outer side plate 391.

An inner plate 395 may be disposed on each of front, bottom, and rear surfaces of the inside of the drawer body 38. The inner plate 395 may be constituted by a front surface part 395*a*, a bottom surface part 395*b*, and a rear surface part 395*c*, which have sizes correspond to the front surface, the bottom surface, and the rear surface of the inside of the drawer body 38. The inner plate 395 may be provided by bending the plate-shaped stainless material so that the inner plate 395 defines the inner surface of the remaining portion except for both the left and right surfaces of the drawer body 38. Also, both left and right ends of the inner plate 395 may contact the inner side plate 392. The front surface part 395*a*, the bottom surface part 395*b*, and the rear surface part 395*c* constituting the inner plate 395 may be separately provided and then coupled to or contact each other.

The entire inner surfaces of the drawer body 38 may be defined by the inner side plate 392 and the inner plate 395, and the inner surface of the drawer body 38 may provide texture of the metal. Thus, the storage space within the drawer part 32 may have a metal texture on the whole, and the foods accommodated in the drawer part 32 may be more uniformly cooled and thus stored at a low temperature in the more uniform region. In addition, visually excellent cooling performance and storage performance may be provided to the user.

Also, upper bent parts 395*d* and 395*e* that are bent outward may be further disposed on the front surface part 395*a* and the rear surface part 395*c* of the inner plate 395 to cover the top surfaces of the front end and the rear end of the drawer body 38, respectively. Also, the rear surface part 395*c* may have a shape corresponding to the inclined surface 321 of the rear surface of the drawer body 38 and thus be closely attached to the inclined surface 321.

Also, a bottom surface opening 395*f* may be further defined in the rear end of the bottom surface part 395*b* adjacent to the lower end of the rear surface part 395*c*. The bottom surface opening 395*f* may be opened at a position corresponding to a cover support part protruding from the bottom surface of the drawer body. Thus, the cover support part may be exposed through the bottom surface opening 395*f*. The lower end of the drawer cover 37 may be coupled to the cover support part so that the drawer cover 37 is mounted.

The drawer cover 37 may include a cover front part 371 that partitions the inside of the drawer body 38 into a front space S1 and a rear space S2 and a cover top surface part 372 bent from an upper end of the cover front part 371 to cover a top surface of the rear space S2.

That is, when the drawer cover 37 is mounted, only the front space S1, in which the support member 35 is disposed, may be exposed in the drawer body 38, and the rear space S2 may be covered by the drawer cover 37.

A lower end of the cover front part 371 may be coupled to the bottom surface of the drawer part 32. Also, a plurality of cover restriction parts 373 may be disposed along both the left and right ends of the drawer cover 37. The cover restriction part 373 may be coupled to a protrusion protruding from the inner surface of the drawer body 38.

If necessary, a separate accommodation member may be further provided inside the drawer cover 37. The drawer cover 37 may be configured to be openable to utilize the accommodation member.

The front surface of the drawer body 38 may be coupled to the rear surface of the front panel door part 31 so that a separate plate is not required to define an outer appearance on the front surface of the drawer body 38. Also, a drawer opening 383 may be defined in the front surface of the drawer body 38 so that the guide device 50 is mounted. The drawer opening 383 may be defined in each of both the sides of the elevation member 45 so that the elevation member 45 passes therethrough. The drawer opening 383 may be elongated in the vertical direction so that the elevation member 45 vertically move.

The guide device 50 may be mounted in the drawer opening 383, and the elevation member 45 may be disposed inside the drawer part 32 through the guide device 50. When the elevation member 45 moves vertically, the opening that is exposed to the inside of the drawer part 32 may be covered by the guide device 50.

The support member 35 may be disposed in the drawer body 38. The support member 35 may include one component of the elevation assembly 40. The support member 35 may have a size that is enough to be accommodated in the front space S1 of the bottom surface of the drawer body 38.

Also, the support member 35 may have a rectangular plate shape. Substantially, the support member 35 may include an elevation plate 351 supporting the food or container and an elevation frame 352 having a rectangular frame shape and supporting the elevation plate 351 at a lower side and reinforcing strength of the elevation plate 351. The support member 35 may be a portion on which the food or container 36 is substantially seated and supported and thus may be called a seating member or a tray. Also, the support member 35 may be provided as one of the elevation plate 351 or elevation frame 352.

The elevation plate 351 may have a rectangular plate shape and include a circumferential part 351*a* protruding upward along a circumference thereof. The circumferential part 351*a* may have an opened bottom surface, and the elevation frame 352 may be accommodated in the circumferential part 351*a*.

Hereinafter, a structure of the guide device will be described in more detail with reference to the accompanying drawings.

Figure 9:
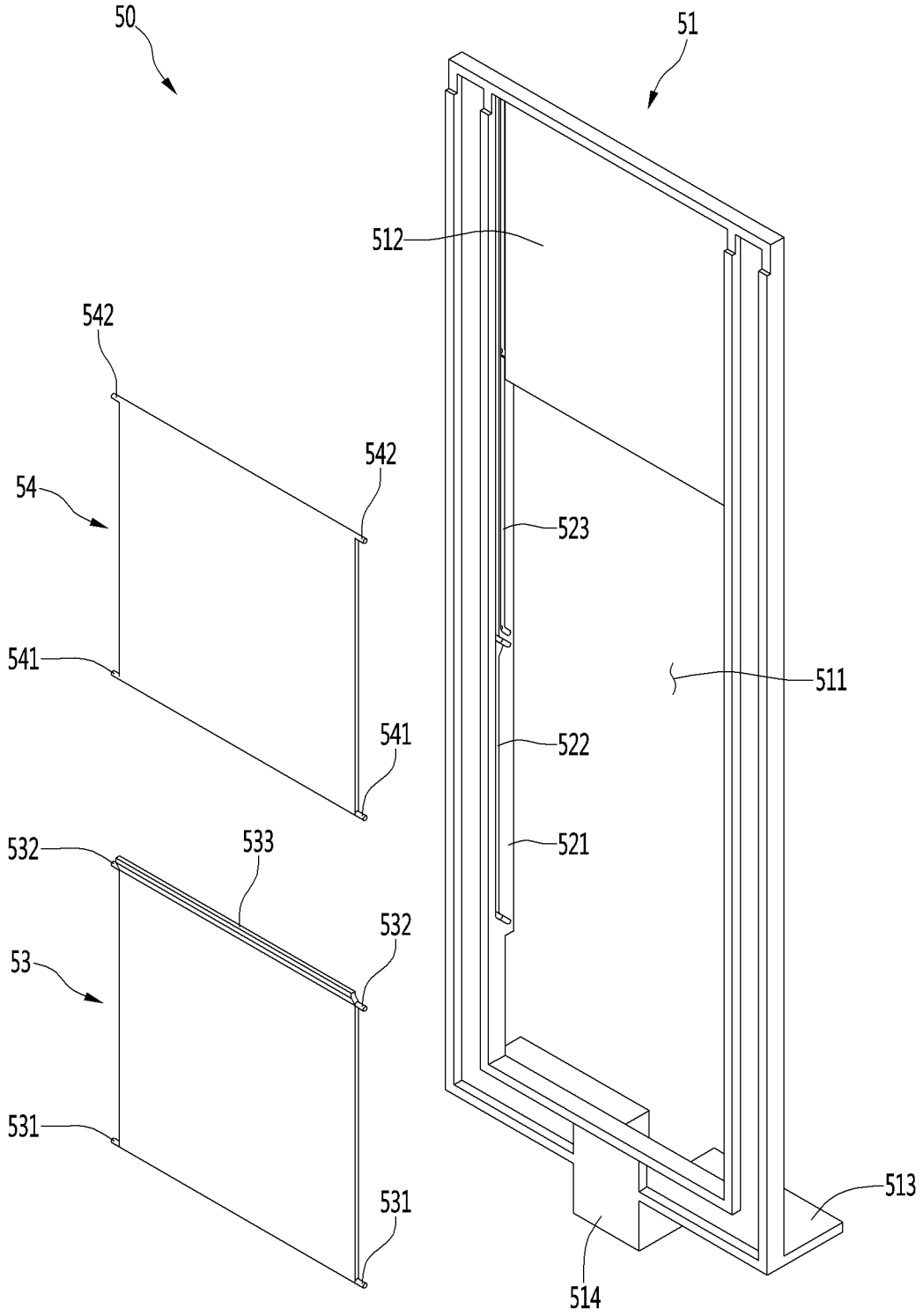
FIG. 9 is an exploded perspective view of a guide device according to an embodiment.

FIG. 9 is an exploded perspective view of the guide device according to an embodiment.

As illustrated in the drawings, the guide device 50 may include a guide frame 51 having a rectangular frame shape and having a guide hole 511 defined in a center thereof and a plurality of shutters 53 and 54 mounted to be slidably movable in the guide hole 511 and covering the guide hole 511.

A plurality of shutters 53 and 54 may be arranged along the moving direction of the elevation member 45. Hereinafter, for convenience of explanation and understanding, it is assumed that the two shutters 53 and 54 are provided.

The guide frame 51 may be mounted on a front surface of the drawer body 38 and also may have a shape corresponding to the drawer opening 383 and mounted in the drawer opening 383. The guide frame 51 may be made of a plastic material, and a structure for guiding the mounting of the shutters 53 and 54 and the movement of the shutters 53 and 54 may be provided.

In detail, a frame bent part 513 bent backward may be disposed on a lower end of the guide frame 51, and a coupling hole 515 through which a screw passes may be disposed on the frame bent part 513 to fix and mount the guide frame 51 to the drawer body 38. Also, a center protrusion 514 may be disposed at a center of the frame bent part 513. A bottom surface of the guide frame 51 may have a stepped structure by the center protrusion 514 so as to be disposed at the correct position when the guide frame 51 is mounted.

A guide hole 511 may be defined in the center of the guide frame 51 to guide the elevation member 45 to move vertically. The guide hole 511 may be lengthily defined in the vertical direction and may have a length corresponding to a vertical movement length of at least the elevation member 45.

Also, a shutter guide part 52 may be disposed on an inner surface of the guide hole 511. The shutter guide part 52 may guide the plurality of shutters 53 so that the shutters 53 move in the vertical direction and may be disposed on each of the left and right sides of the guide hole 511. The shutter guide part 52 may include a guide protrusion 521, a first guide 522, and a second guide 523. A specific structure of the shutter guide part 52 will be described below in more detail.

The shutters 53 and 54 may be provided on an inner side of the guide holes 511 and may have a plate shape to partially cover the guide holes 511. Each of the shutters 53 and 54 may have a lateral width correspond to that of the guide hole 511 and may vertically move by the guide of the shutter guide part 52. The shutters 53 and 54 may include a first shutter 53 and a second shutter 54 having the same vertical lengths and may vertically move upward and downward along the shutter guide part 52.

The first shutter 53 may be disposed below the second shutter 54 in a state where the elevation member 45 does not ascend. Also, a first lower protrusion 531 may be disposed on both left and right sides of a lower end of the first shutter 53, and a first upper protrusion 532 may be disposed on both left and right sides of an upper end of the first shutter 53.

The first lower protrusion 531 and the first upper protrusion 532 may be inserted into the first guide 522 so that the first shutter 53 is mounted inside the guide hole 511, and simultaneously, the first shutter 53 vertically moves.

Also, a shutter bent part 533 may be disposed on an upper end of the first shutter 53. The shutter bent part 533 may be bent forward from the upper end of the first shutter 53 by a thickness of the second shutter 54 and then bent upward. Also, the lower end of the second shutter 54 may be seated on the shutter bent part 533 so that the first shutter 53 supports the second shutter 54 from a lower side. Also, a gap between the upper end of the first shutter 53 and the lower end of the second shutter 54 may be covered by the shutter bent part 533.

The second shutter 54 may be disposed above the first shutter 53 in a state where the elevation member 45 does not ascend. The guide holes 511 may be mostly covered while the first shutter 53 and the second shutter 54 are disposed in parallel to each other, and all the rest portions except for a portion of the lower end through which the elevation member 45 passes may be covered.

Also, a second lower protrusion 541 may be disposed on both left and right sides of a lower end of the second shutter 54, and a second upper protrusion 542 may be disposed on both left and right sides of an upper end of the second shutter 54. The second lower protrusion 541 and the second upper protrusion 542 may be inserted into the second guide 523 so that the second shutter 54 is mounted inside the guide hole 511, and simultaneously, the second shutter 54 vertically moves.

Since an additional shutter is not provided above the second shutter 54, the shutter bent part 533 may not be disposed on the upper end of the second shutter 54. Also, the upper end of the second shutter 54 may be disposed at a position corresponding to the upper end of the guide hole 511 to cover the guide hole 511. When the additional shutter is provided above the second shutter 54, the shutter bent part 533 may be further disposed on the upper end of the second shutter 54.

A cover part 512 may be disposed above the guide hole 511. The cover part 512 may be disposed above the second shutter 54, and the upper end of the second shutter 54 and the lower end of the cover part 512 may be disposed to overlap each other in the state in which the second shutter 54 is disposed at the lowermost side.

Also, a vertical length of the cover part 512 may be greater than that of each of the shutters 53 and 54, i.e., each of the first and second shutters 53 and 54. Thus, the first shutter 53 and the second shutter 54 may overlap each other on the front surface of the cover part 512 in a state in which the elevation member 45 moves to the uppermost position. Also, the first shutter 53 and the second shutter 54 may be covered by the cover part 512 when viewed from the inside of the drawer part 32.

Hereinafter, the shutter guide part 52 for guiding the vertical movement of the shutters 53 and 54 will be described in more detail.

Figure 10:
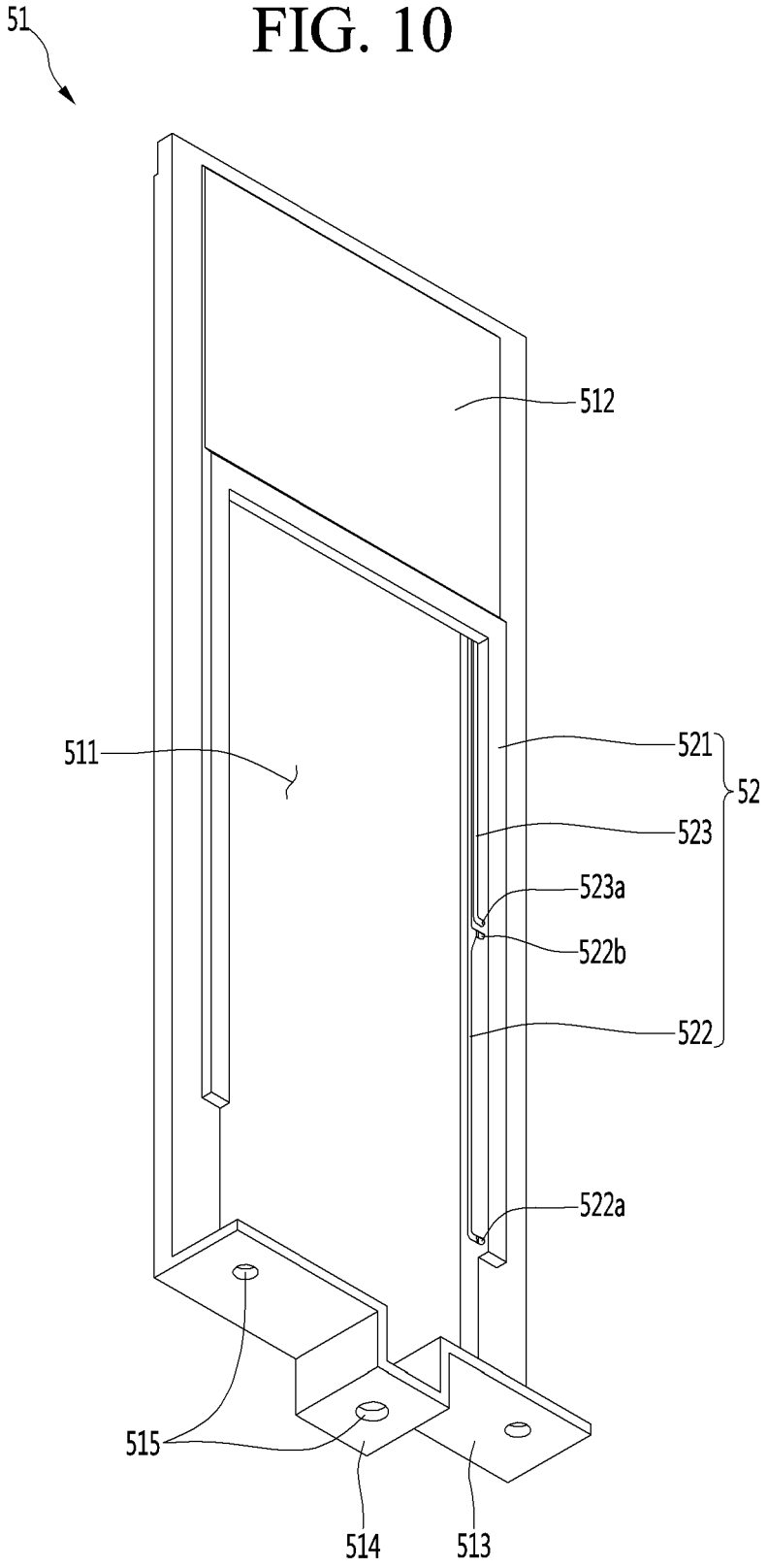
FIG. 10 is a perspective view illustrating a guide frame of the guide device.
Figure 11:
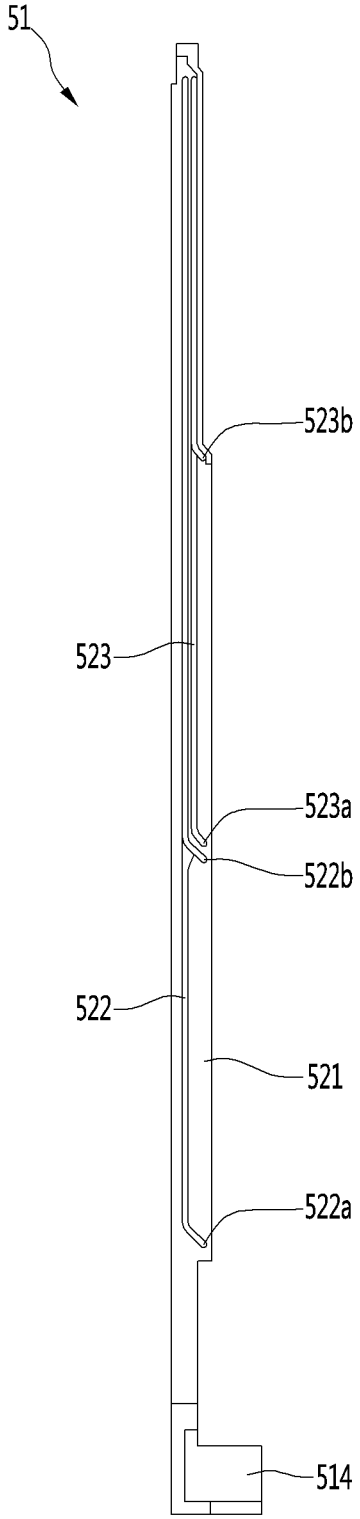
FIG. 11 is a longitudinal cross-sectional view of the guide frame.

FIG. 10 is a perspective view illustrating the guide frame of the guide device. Also, FIG. 11 is a longitudinal cross-sectional view of the guide frame.

As illustrated in the drawings, the shutter guide part 52 may be disposed on both left and right sides of the guide hole 511 of the guide frame 51. The shutter guide part 52 may be disposed along both sides of the guide hole 511 so that the guide hole 511 is opened and closed while the first shutter 53 and the second shutter 54 move vertically along the guide hole 511.

In detail, the shutter guide part 52 may include a guide protrusion 521, a first guide 522, and a second guide 523. The guide protrusion 521 provides a surface on which the first guide 522 and the second guide 523 are capable of being disposed. That is, the guide protrusion 521 may define at least a portion of each of both sides of the guide hole 511 and extend to the area of the cover part 512.

Also, the guide protrusion 521 may protrude backward along the guide hole 511 by a predetermined height. Thus, the rear surface of each of the shutters 53 and 54 and the rear surface of the guide device 50 may be disposed on the same plane when the shutters 53 and 54 are closed. That is, the shutters 53 and 54 are disposed on the same plane as the inner surface of the drawer part 32 in the closed state to prevent a stepped portion from occurring, thereby improving the outer appearance and prevent foods from being caught through the stepped portion or the gap.

Also, the lower end of the guide protrusion 521 may be disposed at a position spaced apart from the lower end of the guide hole 511. Thus, the shutters 53 and 54 may be disposed at positions away from the lower end of the guide hole 511 in the state in which the shutters 53 and 54 are completely closed to provide a space into which the elevation member 45 is inserted.

The first guide 522 and the second guide 523 may be disposed on a surface of the guide protrusion 521 facing the inside of the guide hole 511. Also, the first guide 522 and the second guide 523 may be disposed on the inner side surfaces of the guide protrusion 521 on the left and right sides facing the guide hole 511, respectively.

The first guide 522 may extend from the lower end of the guide protrusion 521 to the upper end of the guide protrusion 521 and be recessed in a size at which the first upper protrusion 532 and the second upper protrusion 542 are insertable. Thus, the first shutter 53 may move in the vertical direction along the first guide 522 and also move from the lower end of the guide protrusion 521 to the shutter cover part 512.

Also, a first lower groove 522*a* extending obliquely backward and downward may be defined in the lower end of the first guide 522. The first lower groove 522*a* may be defined so that the first lower protrusion 531 is inserted in a state in which the first shutter 53 is disposed at the lowermost position. Also, the first shutter 53 may moves backward while the first lower protrusion 531 is inserted into the first lower groove 522*a* so that the rear surface of the first shutter 53 is disposed on the same plane as the drawer part 32.

Also, a first upper groove 522*b* may be defined above the first lower groove 522*a*. The first upper groove 522*b* may be defined in parallel with the first lower groove 522*a* and may extend backward and downward from one side of the first guide 522 extending in the vertical direction. Also, the first upper groove 522*b* may be defined so that the first upper protrusion 532 is inserted.

The first upper protrusion 532 may be inserted into the first upper groove 522*b* when the first lower protrusion 531 is inserted into the first lower groove 522*a*. Thus, when the first shutter 53 moves downward, the first upper protrusion 532 and the first lower protrusion 531 may inserted into the first upper groove 522*b* and the first lower groove 522*a* at the same time to move backward and downward.

A second guide 523 for guiding the second shutter 54 may be disposed behind the first guide 522. The second guide 523 may extend in parallel with the first guide 522. The second guide 523 may extend upward from the upper end of the first upper groove 522*b* of the first guide 522 and extend to the upper end of the cover part 512 like the first guide 522. Thus, the second shutter 54 may move upward from the upper side of the first shutter 53 along the second guide 523 to a position at which the second shutter 54 is covered by the cover part 512.

A second lower groove 523*a* extending obliquely backward and downward may be defined in the lower end of the second guide 523. The second lower protrusion 541 may be accommodated in the second lower groove 523*a*, and the second lower protrusion 541 may be disposed inside the second lower groove 523*a* when the second shutter 54 is disposed at the lowest position.

Also, a second upper groove 523*b* may be defined above the second lower groove 523*a*. The second upper groove 523*b* may be defined to have an inclination corresponding to the second lower groove 523*a*, and when the second lower protrusion 541 is inserted into the second lower groove 523*a*, the second upper protrusion 542 may also be defined in a position corresponding to a position to be inserted into the second upper groove 523*b*. Here, the second upper groove 523*b* may be disposed further above the lower end of the cover part 512.

The second upper protrusion 542 and the second lower protrusion 541 may move vertically along the second guide 523. Thus, the second shutter 54 may move along the second guide 523.

In the state in which the second shutter 54 is disposed at the lowest position, the second upper groove 523*b* and the second lower groove 523*a* may be defined so that the rear surface of the second shutter 54 is disposed on the same plane as the rear surface of the first shutter 53 and the inner surface of the drawer part 32. Also, the first shutter 53, the second shutter 54, and the inner plate 395 of the drawer part 32 may be made of the same material so that the outer appearance of the inner shutter 395 has a sense of unity.

Hereinafter, the operation of the guide device 50 having the above structure will be described with reference to the drawings.

Figure 12A:
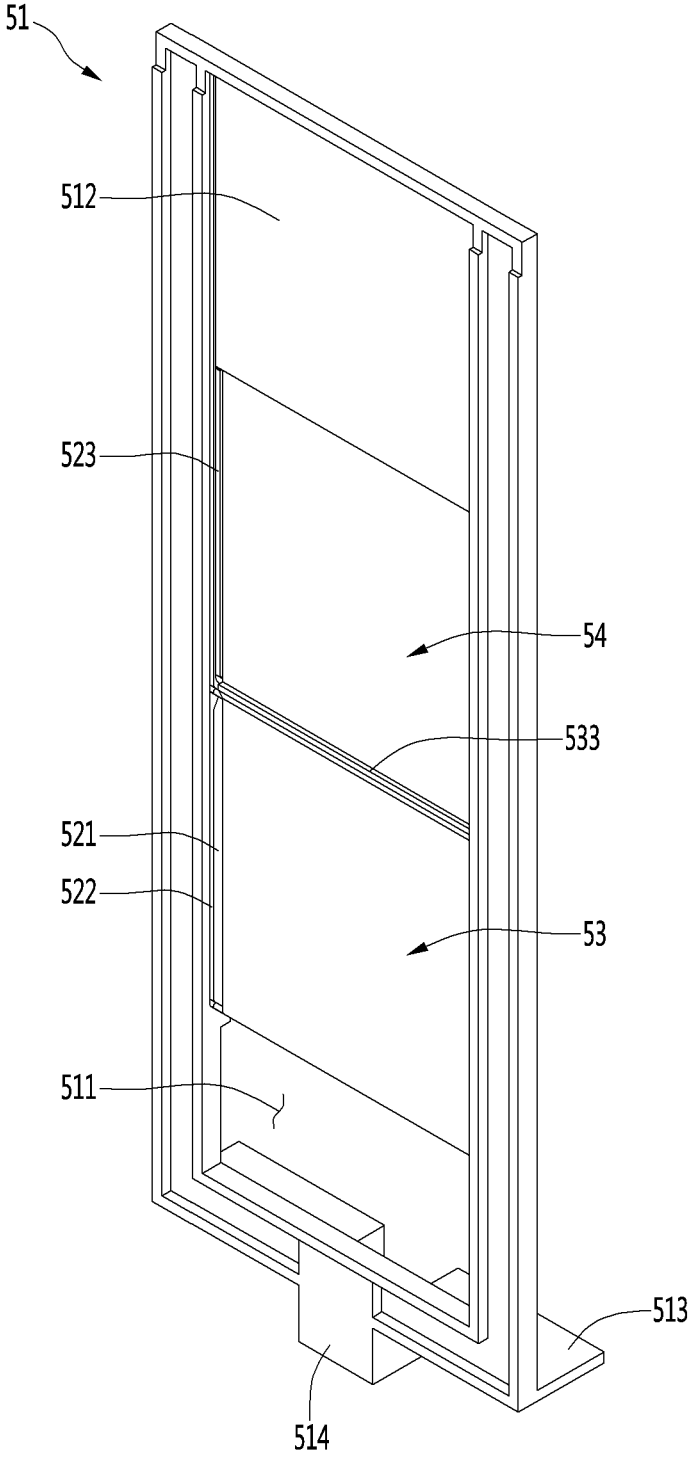
FIG. 12A is a perspective view illustrating a state in which the guide device is completely covered.
Figure 12B:
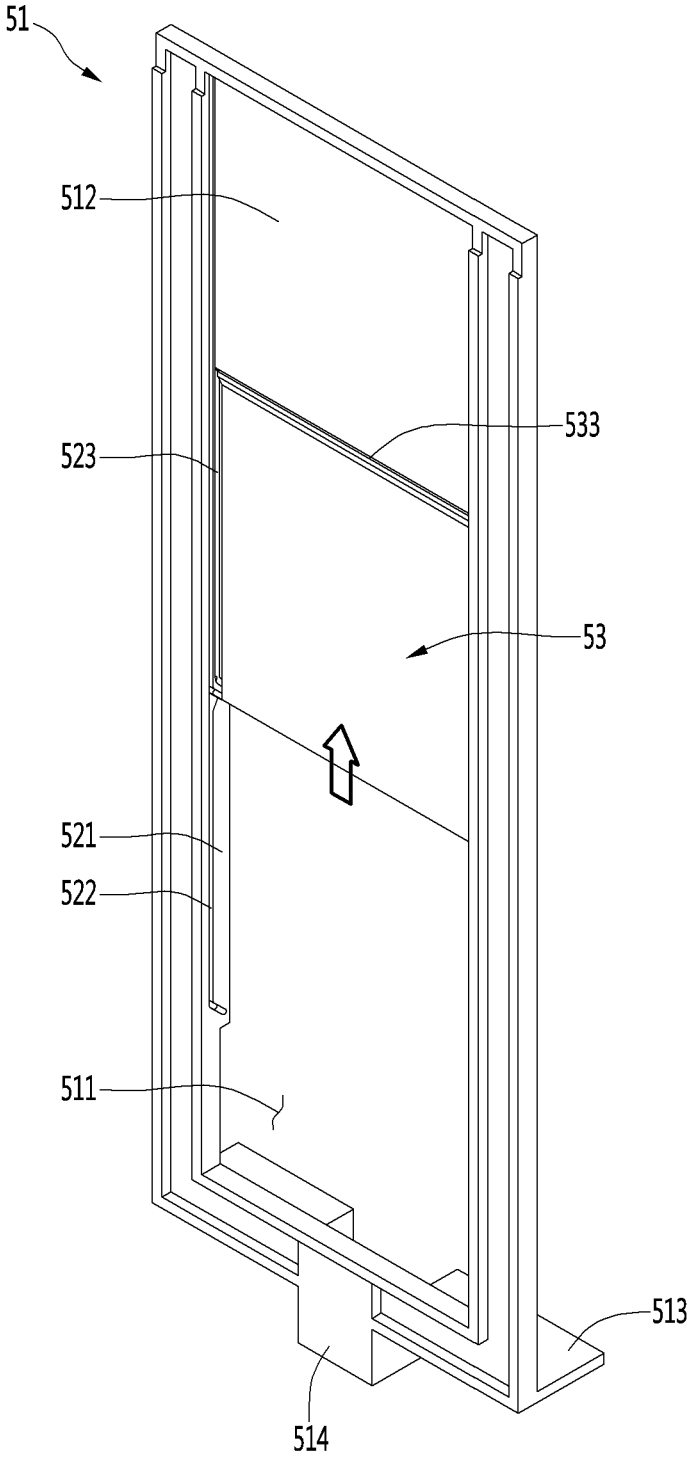
FIG. 12B is a perspective view illustrating a state in which the guide device is partially covered.
Figure 12C:
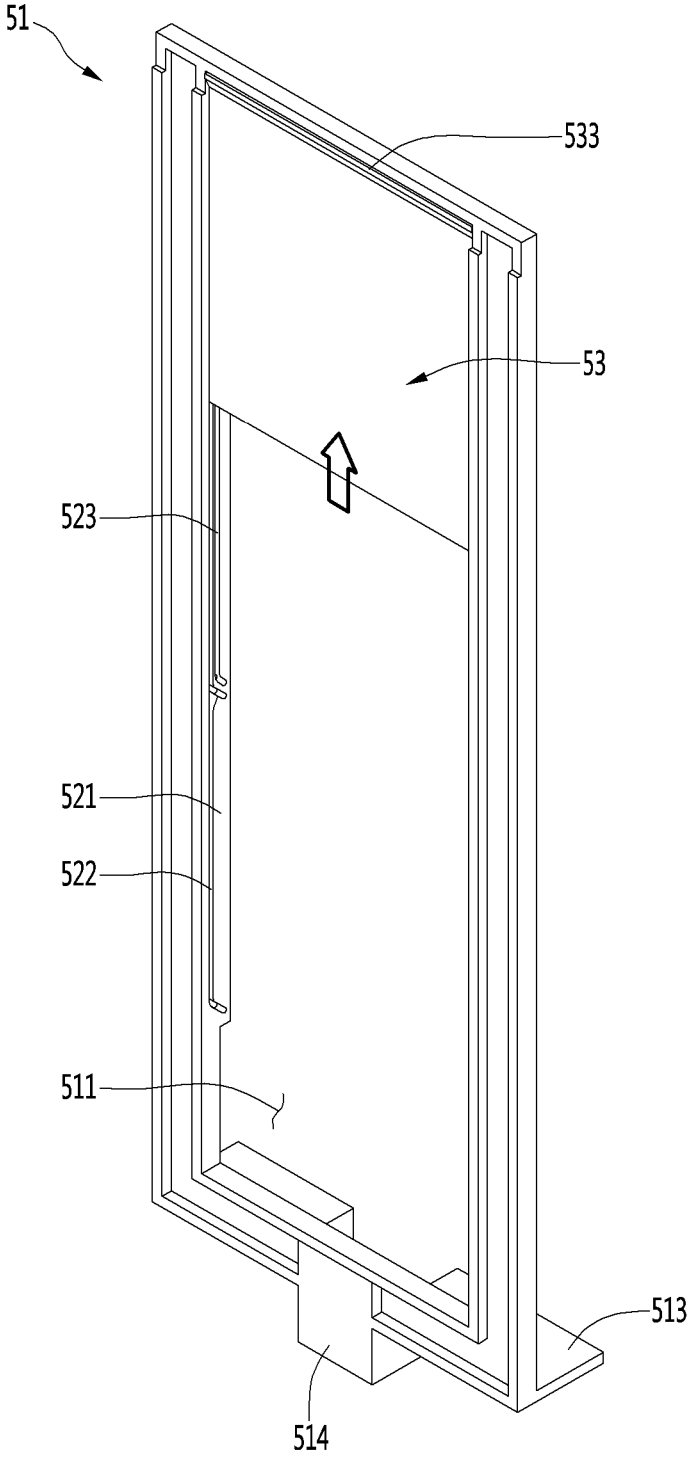
FIG. 12C is a perspective view illustrating a state in which the guide device is completely opened.
Figure 13:
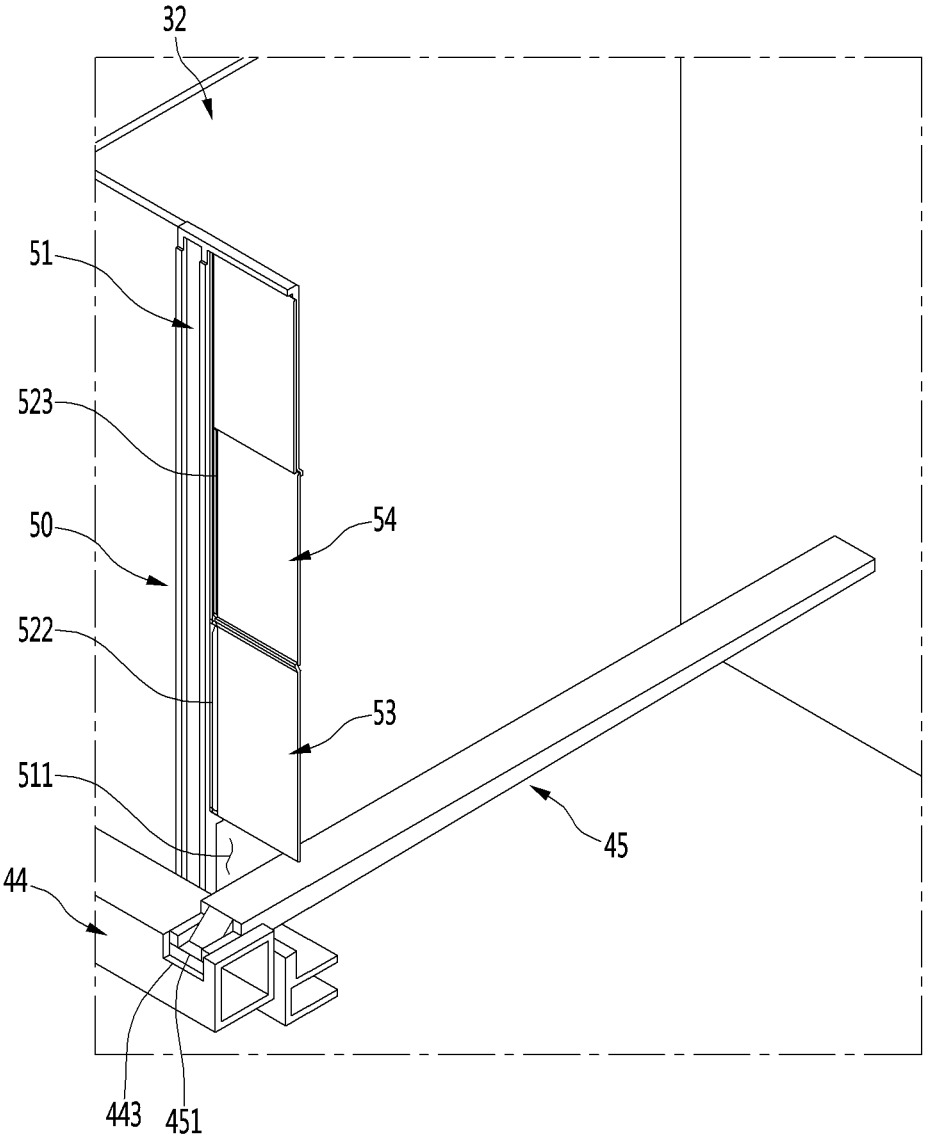
FIG. 13 is a perspective view illustrating a state of the guide device when the elevation assembly is disposed at the lowermost side.
Figure 14:
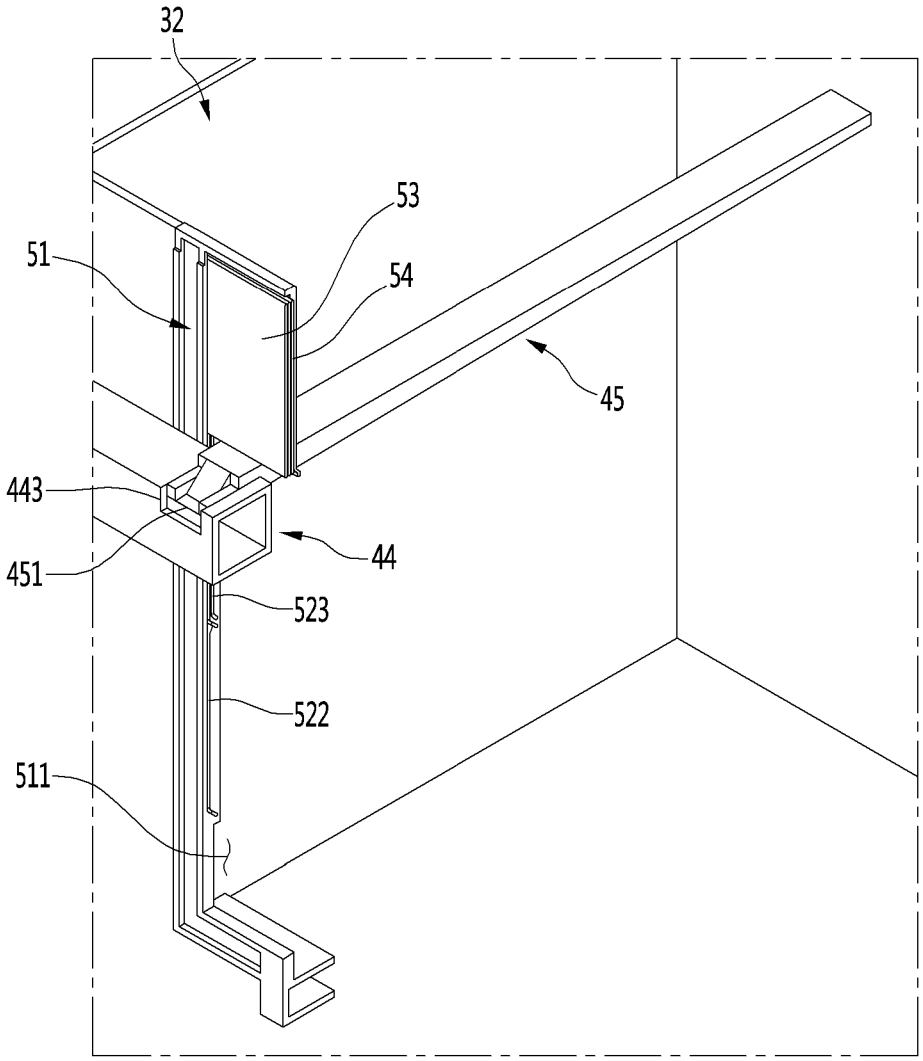
FIG. 14 is a perspective view illustrating a state of the guide device when the elevation assembly is disposed at the uppermost side.

FIGS. 12A to 12C are perspective views sequentially illustrating an operation state of the guide device. FIG. 13 is a perspective view illustrating a state of the guide device when the elevation assembly is disposed at the lowermost side. FIG. 14 is a perspective view illustrating a state of the guide device when the elevation assembly is disposed at the uppermost side.

As illustrated in FIGS. 12A and 13, when the elevation assembly 40 does not operate in the state in which the elevation member 45 is mounted on the elevation assembly 40, all the rest regions except of a portion of the lower end of the guide hole 511 may be covered by the first shutter 53 and the second shutter 54.

Here, the elevation member 45 may pass through the lower end of the guide hole 511 opened below the first shutter 53 and extend to the inside of the drawer part 32 to support the support member 35 from a lower side.

Particularly, the guide device 50 may be disposed at the lowest position of the first guide 522 and the second guide 523 in a state in which the first shutter 53 and the second shutter 54 completely move downward. Here, separate external force may not be applied to the first shutter 53 and the second shutter 54, and the first shutter 53 and the second shutter 54 may be disposed at the lowest positions due to the self-weight of each of the first shutter 53 and the second shutter 54.

Here, the first upper protrusion 532 and the first lower protrusion 531 of the first guide 522 may be disposed in the first upper groove 522*b* and the first lower groove 522*a*, and the first shutter 53 may move downward and backward by the inclination of each of the first upper groove 522*b* and the first lower groove 522*a*.

Here, the second upper protrusion 542 and the second lower protrusion 541 of the second guide 523 may be disposed in the second upper groove 523*b* and the second lower groove 523*a*, and the second shutter 54 may move downward and backward by the inclination of each of the second upper groove 523*b* and the second lower groove 523*a*.

In this state, the second shutter 54 may be seated on the shutter bent part 533 at the upper end of the first shutter 53, and the first shutter 53 and the second shutter 54 may be disposed on the same plane. Also, the upper end of the second shutter 54 contacts the lower end of the cover part 512. Thus, the rear surface of the first shutter 53, the rear surface of the second shutter 54, and the inner surface of the drawer part 32 may be disposed on the same plane so that when viewed from the inside of the drawer part 32, the guide device 50 may have a sense of unity with the drawer part 32.

Also, the lower end of the first shutter 53 may be disposed further below the position of the support member 35. Thus, in the state in which the support member 35 is mounted, the elevation member and the opened lower portion of the guide hole 511 through which the elevation member 45 passes may not be exposed to the outside.

In this state, the elevation assembly 40 may operate by user's manipulation, and the elevation member 45 may ascend. The elevation member 45 may further ascend along the guide hole 511.

When the elevation member 45 ascends by a predetermined height, the top surface of the elevation member 45 may contact the lower end of the first shutter 53. Thus, as the elevation member 45 further ascends, the first shutter 53 may be lifted. When the first shutter 53 is lifted upward from a lower side of the first shutter 53 by the ascending of the elevation member 45, the first shutter 53 may move upward.

In detail, in the state of FIG. 13, when the elevation member 45 moves upward by the driving of the elevation assembly 40, the first shutter 53 may be lifted upward.

Here, the first upper protrusion 532 and the first lower protrusion 531 of the first shutter 53 may move forward and upward along the inclination of the first upper groove 522*b* and the first lower groove 522*a*, respectively. Also, the first upper protrusion 532 and the first lower protrusion 531 which are out of the first upper groove 522*b* and the second upper groove 523*b* may move upward along the first guide 522 extending vertically from the front side of the second guide 523.

That is, the second shutter 54 of the first shutter 53 and the second shutter 54, which are disposed on the same plane may be maintained in the current position, and the first shutter 53 may move to the front side of the second shutter 54 and then move upward again. The first shutter 53 may move vertically in a state where the first shutter 53 overlaps the second shutter 54 according to the continuous upward movement of the elevation member 45.

The first shutter 53 may continuously moves upward by the continuous movement of the elevation member 45. As illustrated in FIG. 12B, the first shutter 53 may move upward until the whole of the first shutter 53 moves is disposed behind the second shutter 54.

Also, when the elevation member 45 further moves upward, the first shutter 53 may move up to the same height as the second shutter 54. Thus, in the state of FIG. 12B, the top surface of the elevation member 45 may contact the lower end of the first shutter 53 as well as the lower end of the second shutter 54 when the elevation member 45 further moves upward.

In this state, when the elevation member 45 further ascends, the first shutter 53 continuously ascends along the vertical region of the first guide 522. Also, the second shutter 54 may also be pushed up by the elevation member 45. Here, the second upper protrusions 542 and the second lower protrusions 541 of the second shutter 54 may move forward and upward along the inclined second upper groove 523*b* and the inclined second lower groove 523*a*, respectively. Also, the second upper protrusion 542 and the second lower protrusion 541 which are out of the second upper groove 523*b* and the second lower groove 523*a* may move upward along the vertical region of the second guide 523.

When the elevation member 45 continuously ascends, although the second shutter 54 moves forward, the second guide 523 may be disposed behind the first guide 522. Thus, the second shutter 54 may also be disposed behind the first shutter 53 and move upward. Here, since all of the first guide 522 and the second guide 523 extend vertically at the rear side of the cover part 512, the first shutter 53 and the second shutter 54 may also move to the rear side of the cover part 512.

Also, the first shutter 53 and the second shutter 54 may ascend by the continuous ascending of the elevation member 45. Thus, the opening area of the guide hole 511 may gradually increase upward. However, since the elevation member 45 supports the support member 35 from the lower side, the opened area of the guide hole 511, which increases to the lower side of the elevation member 45, may be naturally disposed below the support member 35 and thus may not be exposed to the outside.

The elevation member 45 may continuously ascend up to a height at which the support member 35 reaches a maximum height. When the elevation member 45 ascends to the maximum height, as illustrated in FIGS. 12C and 14, all of the first shutter 53 and the second shutter 54 may move upward and be disposed behind the cover part 512 and thus be covered by the cover part 512.

That is, the elevation member 45 may operate until the elevation member 45 is disposed at the maximum height by the operation of the elevation assembly 40 so that the support member 35 is disposed at a set height. When the elevation member 45 reaches the maximum height, the first shutter 53 and the second shutter 54 may be entirely disposed in front of the cover part 512 as shown in FIG. 14, and thus, the first shutter 53 and the shutter 54 may be covered without being exposed to the outside.

When the user's food storage is completed in a state where the support member 35 moves to the uppermost position, the elevation assembly 40 may be driven by the user's manipulation to allow the elevation member to move downward, and thus, the support member 35 may move downward.

As illustrated in FIG. 13, the elevation member 45 may move downward at its initial position. When the elevation member 45 moves downward, the first shutter 53 and the second shutter 54 may move downward by their own weight.

When the elevation member 45 moves, the first shutter 53 and the second shutter 54 may move downward together. Here, the first shutter 53 and the second shutter 54 may move downward by their own weight without applying external force to the first shutter 53 and the second shutter 54. Also, the first shutter 53 and the second shutter 54 may respectively move downward along the first guide 522 and the second guide 523. Here, the second shutter 54 may reach the initial position, and then, the first shutter 53 may reach the initial position.

The second shutter 54 may move to the second upper groove 523*b* and the second lower groove 523*a* through the vertical region of the second guide 523, and while the second upper protrusion 542 and the second lower protrusion 541 are inserted into the second upper groove 523*b* and the second lower groove 523*a*, the second upper protrusion 542 and the second lower protrusion 541 may move backward and downward to complete the downward movement, thereby covering a portion of the guide hole 511.

Also, the first shutter 53 may continuously move downward along the vertical direction of the first guide 522 even when the downward movement of the second shutter 54 is completed.

Just before the first shutter 53 completely moves downward, the first upper protrusion 532 and the first lower protrusion 531 may move downward and backward along the first upper groove 522*b* and the first lower groove 522*a*. When the first shutter 53 completely moves downward, the lower end of the second shutter 54 may be seated on the shutter bent part 533 of the upper end of the first shutter 53. Also, the first shutter 53 may cover a portion of the opened area of the guide hole 511 below the second shutter 54.

In this state, the guide holes 511 may be completely covered by the first shutter 53 and the second shutter 54 except for the area in which the elevation member 45 is accessible. Also, when viewed from the inside of the drawer part 32 on which the support member 35 is mounted, all of the guide holes 511 may be seen as being covered by the first shutter 53 and the second shutter 54.

Hereinafter, a state in which the drawer door 30 of the refrigerator 1 is inserted and withdrawn and is elevated according to an embodiment will be described in more detail with reference to the accompanying drawings.

Figure 15:
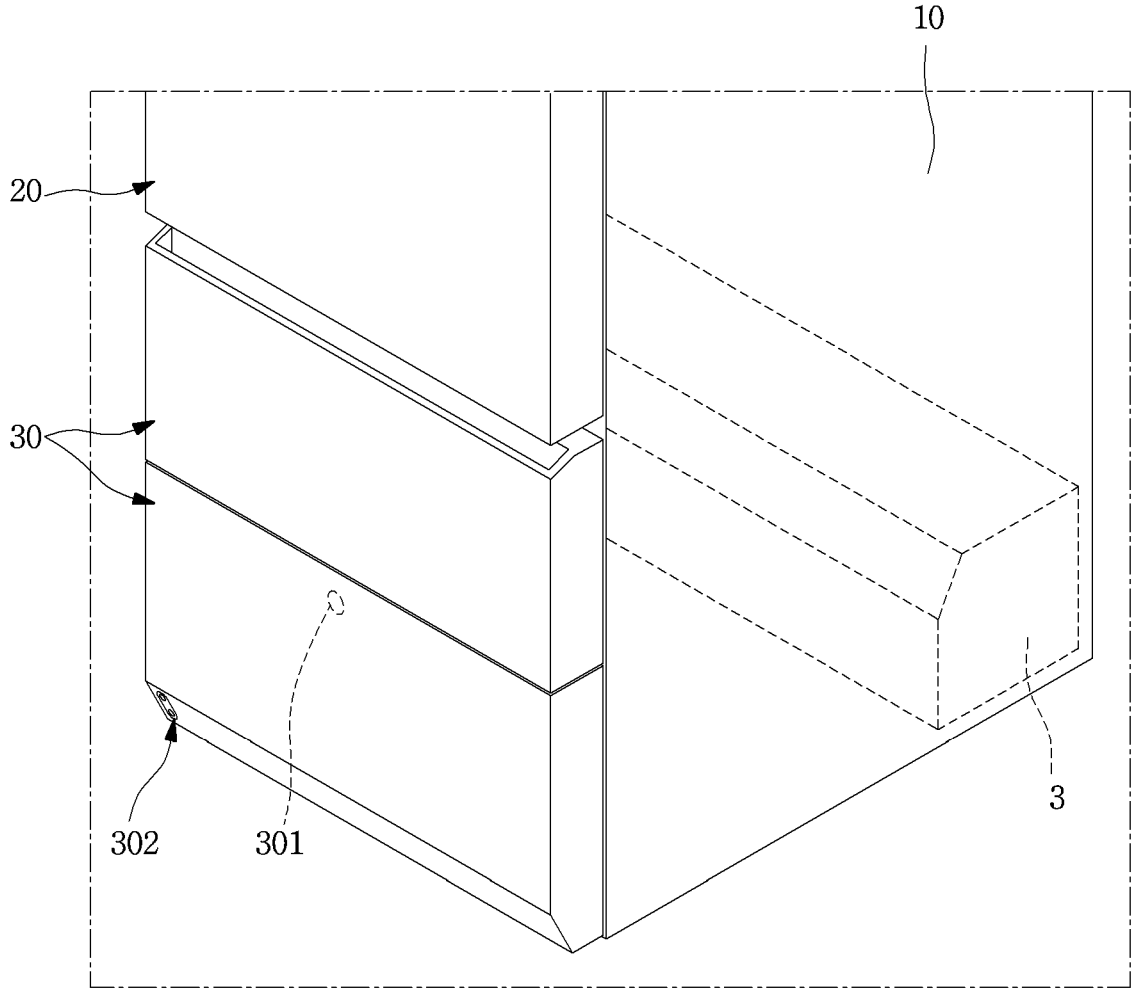
FIG. 15 is a view illustrating a state in which the drawer door is closed.

FIG. 15 is a view illustrating a state in which the drawer door is closed.

As illustrated in the drawing, in the state in which the food is stored, the refrigerator 1 may be maintained in a state in which all of the rotation door 20 and the drawer door 30 are closed. In this state, the user may withdraw the drawer door 30 to accommodate the food.

The drawer door 30 may be provided in plurality in a vertical direction and be withdrawn to be opened by the user's manipulation. Here, the user's manipulation may be performed by touching the manipulation part 301 disposed on the front surface of the rotation door 20 or the drawer door 30. Alternatively, an opening command may be inputted on the manipulation device 302 provided on the lower end of the drawer door 30. Also, the manipulation part 301 and the manipulation device 302 may individually manipulate the insertion and withdrawal of the drawer door 30 and the elevation of the support member 35. Alternatively, the user may hold a handle of the drawer door 30 to open the drawer door 30.

Hereinafter, although the lowermost drawer door 30 of the drawer doors 30, which are disposed in the vertical direction, is opened and elevated as an example, all of the upper and lower drawer doors 30 may be inserted and withdrawn and elevated in the same manner.

Figure 16:
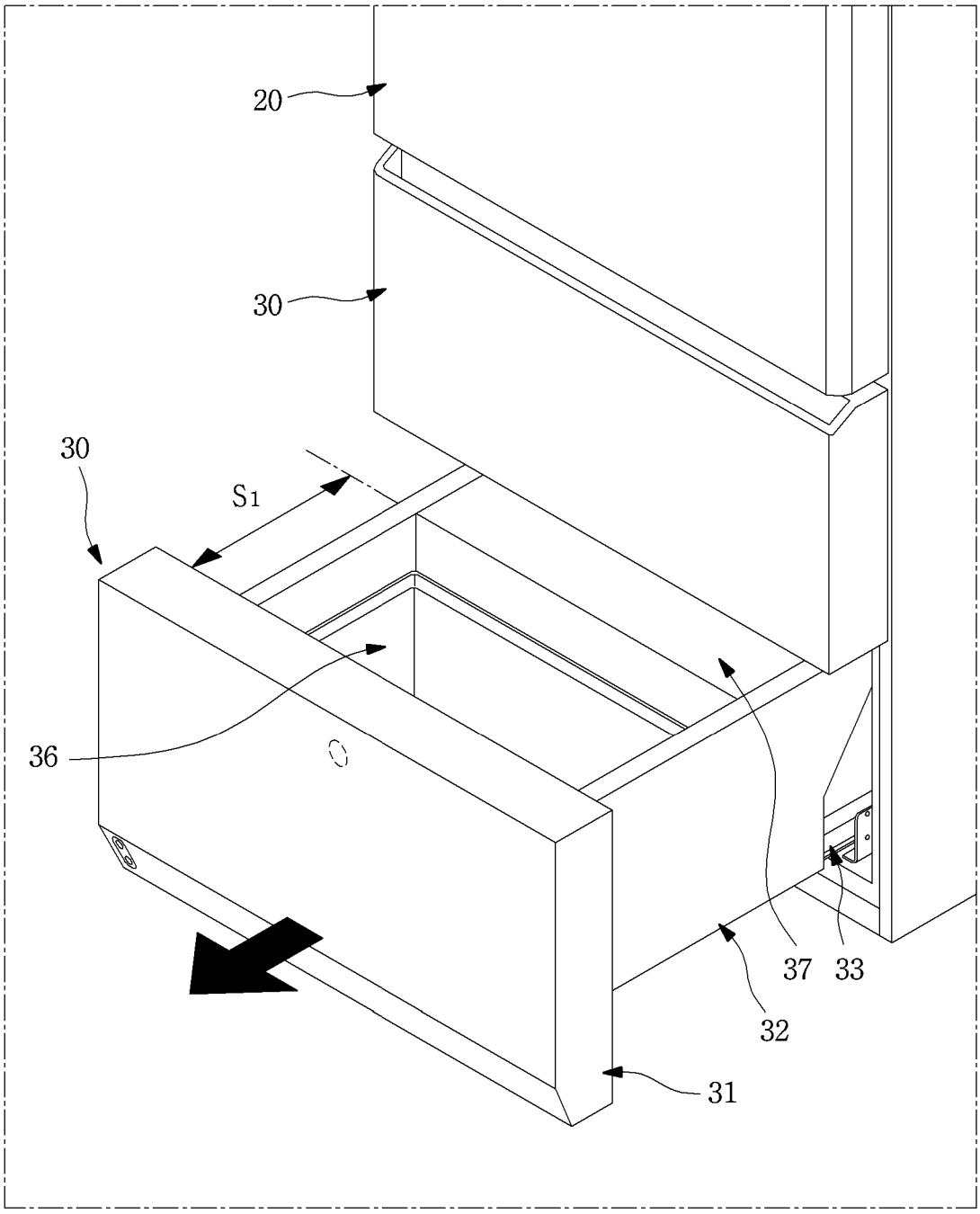
FIG. 16 is a partial perspective view illustrating a state in which the drawer door is withdrawn to be elevated.
Figure 17:
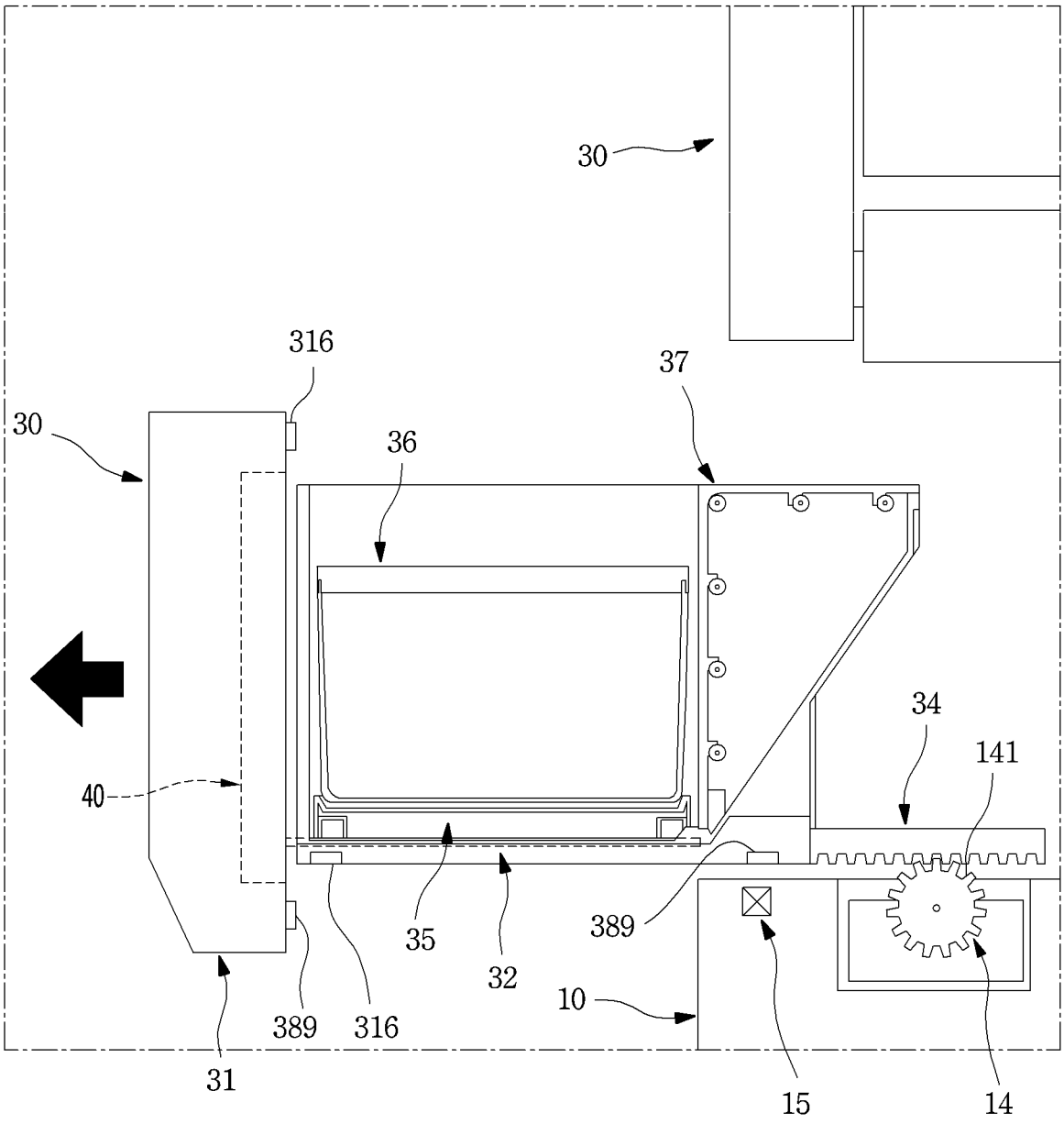
FIG. 17 is a cross-sectional view illustrating a state in which the drawer door is withdrawn.

FIG. 16 is a partial perspective view illustrating a state in which the drawer door is withdrawn to be elevated. Also, FIG. 17 is a cross-sectional view illustrating a state in which the drawer door is withdrawn.

As illustrated in the drawings, the user may manipulate the draw-out operation on the drawer door 30 to withdraw the drawer door 30 forward. The drawer door 30 may be withdrawn while the draw-out rail 33 extends.

The drawer door 30 may be configured to be inserted and withdrawn by the driving of the draw-out motor 14, not by a method of directly pulling the drawer door 30 by the user. The draw-out rack 34 provided on the bottom surface of the drawer door 30 may be coupled to the pinion gear 141 rotating when the draw-out motor 14 provided in the cabinet 10 is driven. Thus, the drawer door 30 may be inserted and withdrawn according to the driving of the draw-out motor 14.

The draw-out distance of the drawer door 30 may correspond to a distance at which the front space S1 within the drawer part 32 is completely exposed to the outside. Thus, in this state, the support member 35 may not interfere with the doors 20 and 30 disposed thereabove or the cabinet 10.

Here, the draw-out distance of the drawer door 30 may be determined by a draw-out detection device 15 disposed on the cabinet 10 and/or the drawer door 30. The draw-out detection device 15 may be provided as a detection sensor that detects a magnet 389 to detect a state in which the drawer door 30 is completely withdrawn or closed.

For example, as illustrated in the drawings, the magnet 389 may be disposed on the bottom of the drawer part 32, and the detection sensor may be disposed on the cabinet 10. The draw-out detection device 15 may be disposed at a position corresponding to a position of the magnet 389 when the drawer door 30 is closed and a position of the magnet 389 when the drawer door 30 is completely withdrawn. Thus, the draw-out state of the drawer door 30 may be determined by the draw-out detection device 15.

Also, as necessary, a switch may be provided at each of positions at which the drawer door 30 is completely inserted and withdrawn to detect the draw-out state of the drawer door 30. In addition, the draw-out state of the drawer door 30 may be detected by counting the rotation number of draw-out motor 14 or measuring a distance between the rear surface of the front panel door part 31 and the front end of the cabinet 10.

In the state in which the drawer door 30 is completely withdrawn, the elevation motor 411 may be driven to elevate the support member 35. The support member 35 may be driven in an even situation in which the drawer door 30 is sufficiently withdrawn to secure safe elevation of the food or container 36 seated on the support member 35.

That is, in the state in which the drawer door 30 is withdrawn to completely expose the front space to the outside, the support member 35 may ascend to prevent the container 36 or the stored food seated on the support member 35 from interfering with the doors 20 and 30 or the cabinet 10.

The ascending of the support member 35 may start in a state in which the drawer door 30 is completely withdrawn. Also, to secure the user's safety and prevent the food from being damaged, the ascending of the support member 35 may start after a set time elapses after the drawer door 30 is completely withdrawn.

After the drawer door 30 is completely withdrawn, the user may manipulate the manipulation part 301 to input the ascending of the support member 35. That is, the manipulation part 301 may be manipulated to withdraw the drawer door 30, and the manipulation part 301 may be manipulated again to elevate the support member 35. Also, the drawer door 30 may be manually inserted and withdrawn by a user's hand. After the drawer door 30 is withdrawn, the manipulation part 301 is manipulated to elevate the support member 35.

The elevation assembly 40 may not operate in the process of inserting and withdrawing the drawer door 30, and the elevation operation may be performed only when the drawer door 30 is fully withdrawn. The elevation assembly 40 may be in a state as shown in FIG. 17 until the drawer door 30 is completely withdrawn.

That is, the elevation motor 421 may be maintained in a state in which the elevation motor is not driven, and thus, the elevation member 45 may also be disposed at the lowest position. The elevation member 45 may pass through the guide device 50 and be disposed below the support member 35 to maintain a standby state for ascending.

Also, in this state, the shutters 53 and 54 of the guide device 50 may cover most of the guide hole 511 to become the state shown in FIGS. 12A and 13. In this state, all of the guide holes 511 exposed to the drawer part 32 may be covered by the first shutter 53 and the second shutter 54, and when the user looks at the inside of the drawer part 32, a state of having a feeling of unity with the inside wall surface of the drawer part 32 without generating the stepped portion or the gap may be maintained.

Figure 18:
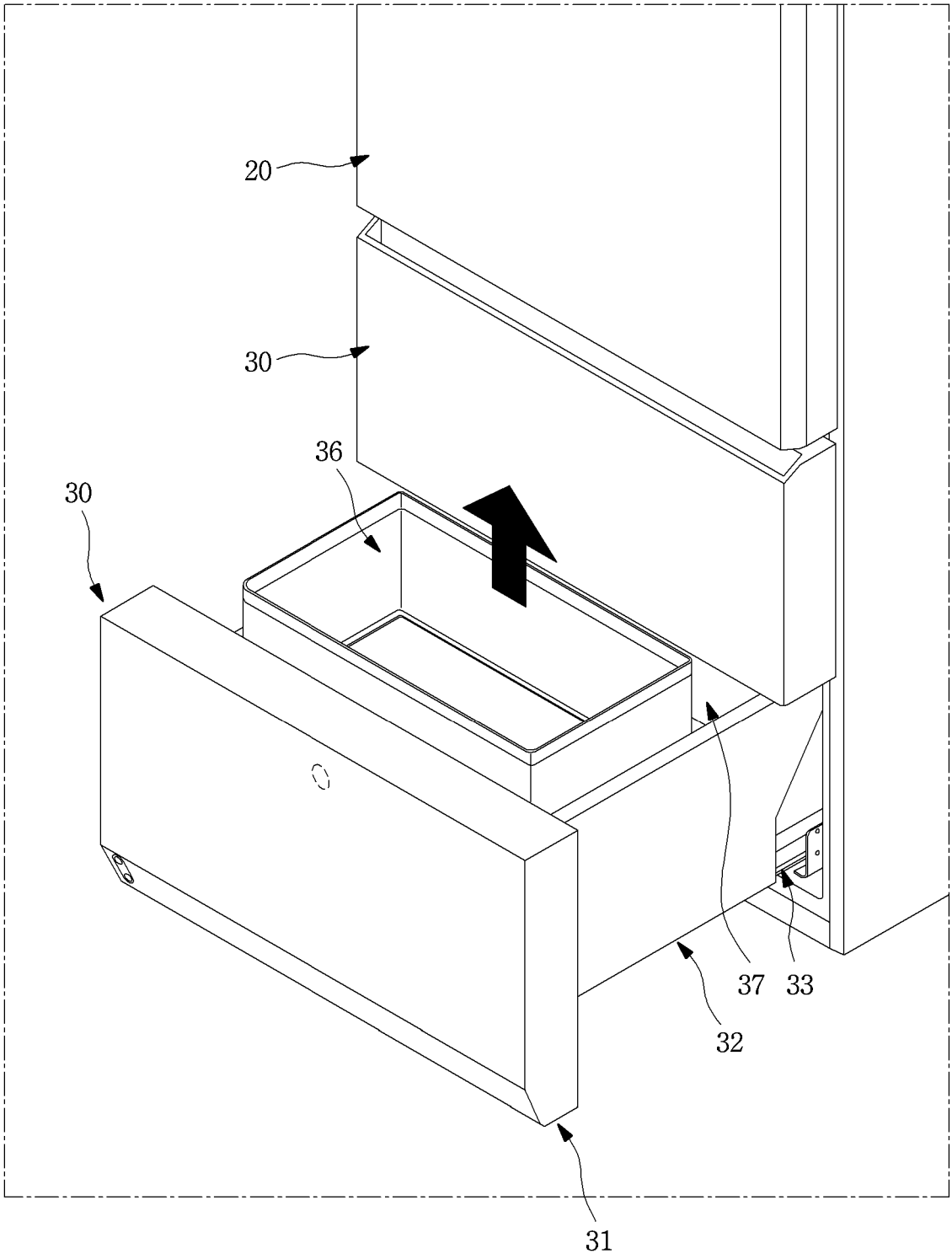
FIG. 18 is a partial perspective view illustrating a state in which the drawer door ascends.
Figure 19:
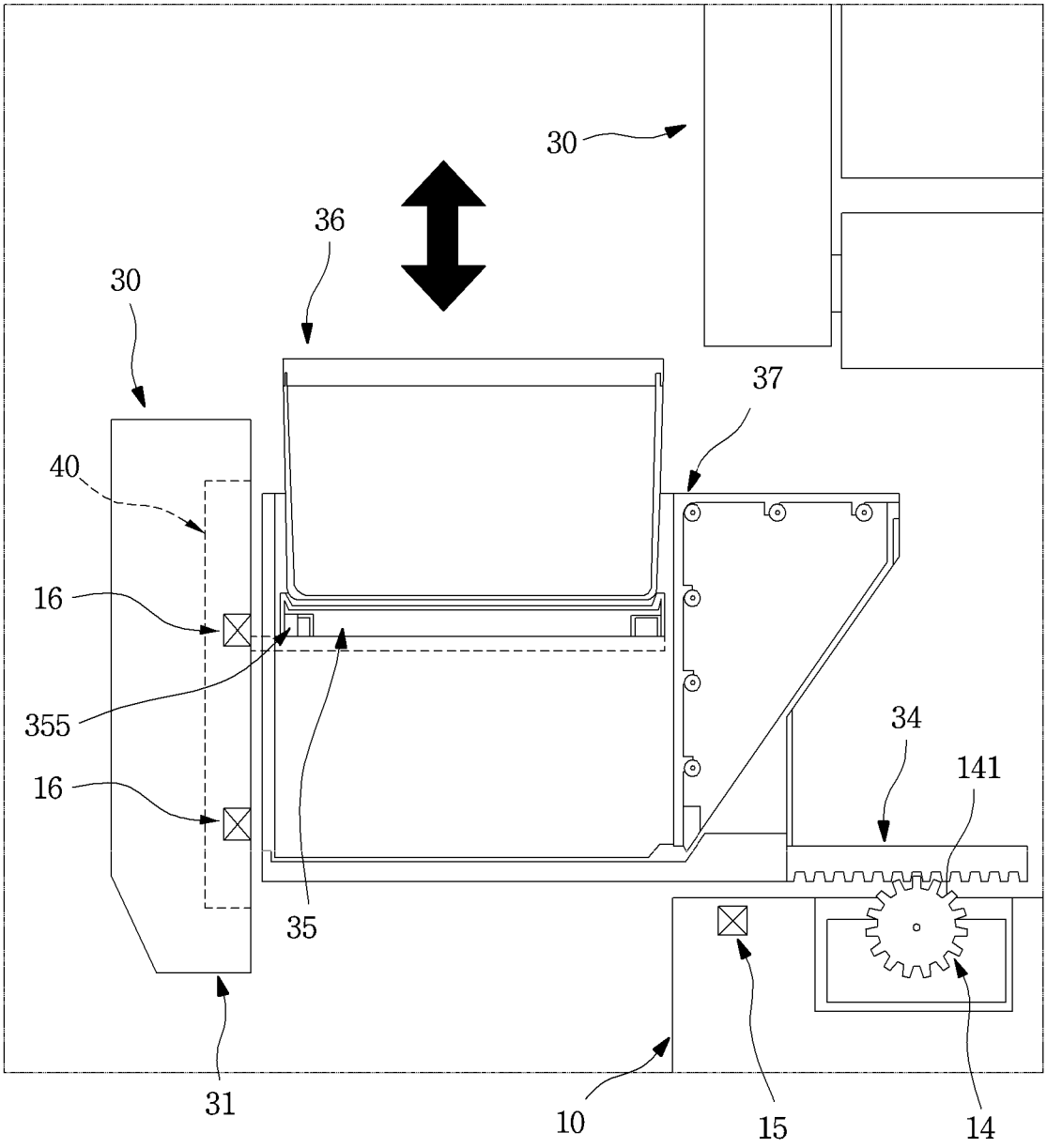
FIG. 19 is a cross-sectional view illustrating the state in which the drawer door ascends.

FIG. 18 is a partial perspective view illustrating a state in which the drawer door ascends. Also, FIG. 19 is a cross-sectional view illustrating the state in which the drawer door ascends.

As illustrated in FIGS. 16 and 17, the elevation assembly 40 may operate, and the elevation of the support member 35 may be performed in a state in which the drawer door 30 is withdrawn more than a set distance so that the front space S1 is completely exposed.

In more detail, when the elevation motor 411 operates, the elevation shaft may rotate by the gear assembly 423 connected to the elevation motor 411, and the elevation block 44 mounted on the elevation shaft 43 may rotate. Here, the upward movement of the elevation member 45 mounted on the elevation block 44 may also cause the upward movement of the elevation member 45 so that the shutters 53 moves upward by the elevation member 45 as illustrated in FIG. 12B. Also, the elevation member 45 may lift the support member 35 in a state of supporting the support member 35 from the lower side.

As the elevation member 45 ascends, the support member 35 may continuously ascend by a sufficient height so that the user is accessible to the food or 36 seated on the support member 35. Thus, the user may easily lift the food or container.

When an ascending completion signal is inputted, the driving of the elevation motor 411 may be stopped. For this, a height detection device 16 for detecting a position of the support member 35 may be provided. The height detection device 16 may be provided in the front panel door part 31 at a height corresponding to the uppermost ascending position of the support member 35 and the lowermost descending position of the support member 35.

The height detection device 16 may be provided as a detection sensor that detects a magnet 355. The height detection device 16 may detect the magnet 355 disposed on the support member 35 to determine whether the ascending of the support member 35 is completed. Also, the height detection device 16 may be provided as a switch structure to turn on the switch when the support member 35 maximally ascends. Also, the height detection device 16 may be provided on the elevation assembly 40 such as the frame 41 or the elevation block 44 to detect the maximally ascending position of the support member 35. Also, whether the support member 35 maximally ascends may be determined according to a variation in load applied to the elevation motor 411.

The driving of the elevation motor 411 is stopped in the state in which the support member 35 maximally ascends. In this state, although the support member 35 is disposed inside the drawer part 32, the food or container 36 seated on the support member 35 may be disposed at a position higher than the opened top surface of the drawer part 32. Thus, the user may easily access the food or container 36. Particularly, it is not necessary to allow the waist excessively for lifting the container 36, so that it is possible to perform safer and more convenient operation.

Also, in the state in which the support member 35 ascends by the maximum height, the guide device 50 may be in the state of FIGS. 12C and 14. That is, the elevation member 45 may ascend at the highest height, and thus, all of the first shutter 53 and the second shutter 54 may ascend up to a position of the cover part 512.

That is, while the elevation member 45 ascends, the first shutter 53 or the second shutter 54 may be maintained in a state of covering the opened region of the guide hole 511 above the elevation member 45 while maintaining the state of contacting the elevation member 45 to prevent the trajectory of the elevation member 45, along which the elevation member 45 moves into the drawer part 32, from being exposed in the opened state.

After the user's food storing operation is completed, the user may allow the support member 35 to descend by manipulating the manipulation part 301. The descending of the support member 35 may be performed by reverse rotation of the elevation motor 411 and may be gradually performed through the reverse procedure with respect to the above-described procedure.

The support member 35 may also descend along with the descending of the elevation member 45, and the first shutter 53 and the second shutter 54 contacting with the elevation member 45 may move downward to gradually cover the guide hole 511, which is opened above the elevation member 45.

Also, when the support member 35 completely descends, the state shown in FIG. 16 or 17 may be achieved, and the guide device may be in a state as shown in FIGS. 12A and 13. Here, the descending completion of the support member 35 may be accomplished by the height detection device 16. The height detection device 16 may be further provided at a position that detects the magnet disposed on the support member 35 when the support member 35 is disposed at the lowermost descending position. Thus, when the completion of the descending of the support member 35 is detected, the driving of the elevation motor is stopped.

Also, after the driving of the elevation motor 411 is stopped, the drawer door 30 may be inserted. Here, the drawer door 30 may be closed by the user's manipulation or by the driving of the draw-out motor 14. When the drawer door 30 is completely closed, a state of FIG. 15 may become.

In addition to the foregoing embodiment, various embodiments may be exemplified.

Hereinafter, another embodiments will be described with reference to the accompanying drawings. In the other embodiments of the present disclosure, the same reference numerals are used for the same components as those of the above-described embodiments, and a detailed description thereof will be omitted.

Figure 20:
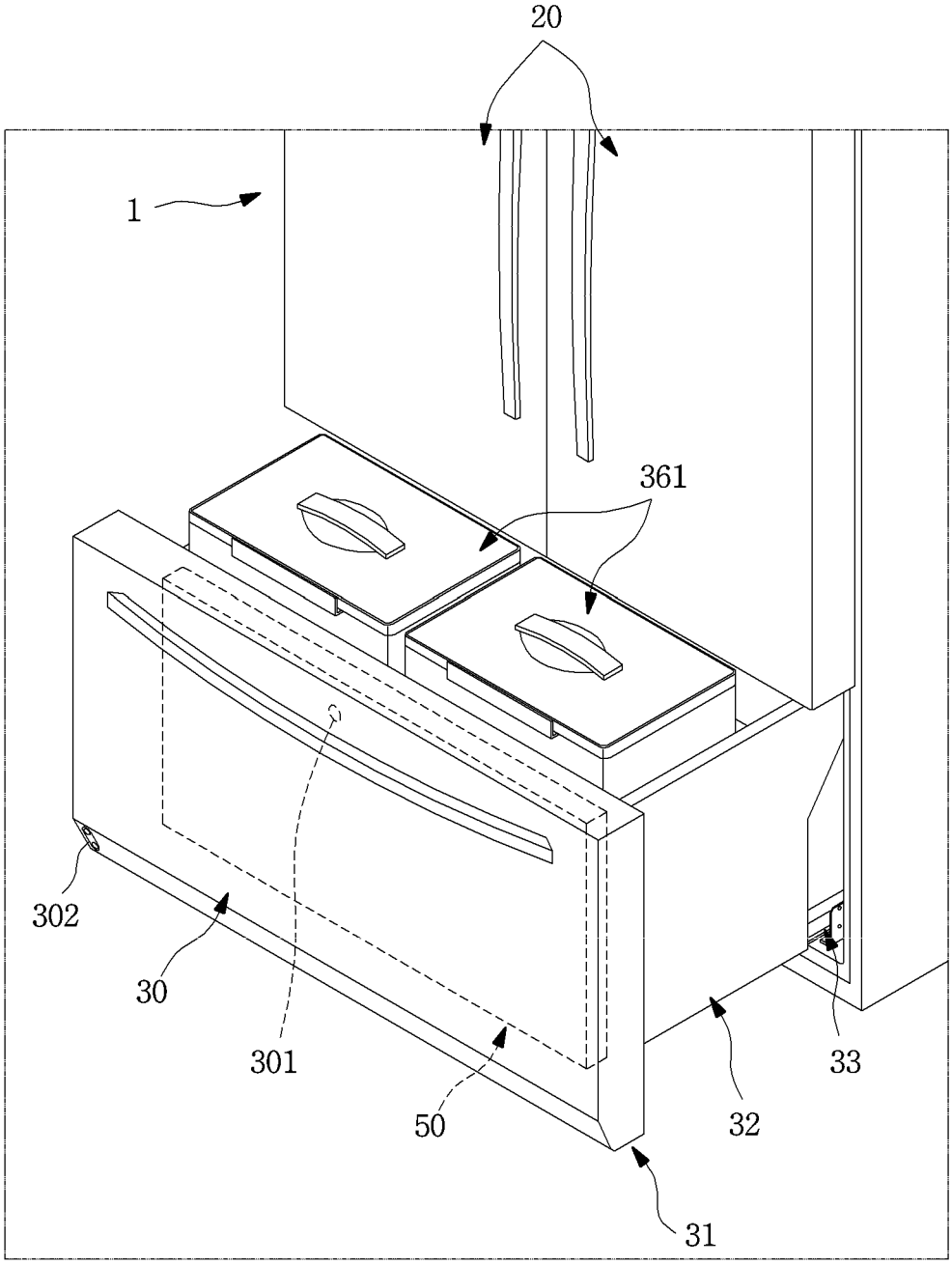
FIG. 20 is a perspective view illustrating a state in which a drawer door of a refrigerator ascends according to another embodiment.

FIG. 20 is a perspective view illustrating a state in which a drawer door of a refrigerator ascends according to another embodiment.

As illustrated in the drawing, a refrigerator 1 according to another embodiment may include a cabinet 10 having a storage space that is vertically partitioned and a door 2 opening and closing the storage space.

The door 2 may include a rotation door 20 which is provided in an upper portion of a front surface of the cabinet 10 to open and close an upper storage space and a drawer door 30 disposed in a lower portion of the front surface of the cabinet 10 to open and close a lower storage space. The drawer door 30 may be inserted and withdrawn forward and backward like the foregoing embodiment. In the state in which the drawer door 30 is withdrawn, the support member 35 within the drawer door 30 may be vertically elevated.

A manipulation part 301 or a manipulation device 302 may be provided at one side of the front panel door part 31. The insertion and withdrawal of the drawer door 30 and/or the elevation of the support member 35 may be realized by manipulating the manipulation part 301 or the manipulation device 302.

Also, the elevation assembly 40 may be provided on the inner side of the front panel door part 31 or on the rear side of the front panel door part 31. The elevation assembly 40 may have the same structure as that of the above-described embodiment. The elevation assembly 40 may be configured such that all of the constituents for driving are disposed in the front panel door part 31. The elevation member 45 may extend inside the drawer part 32 through the drawer part 32, thereby supporting the support member 35 from the lower side.

Thus, the support member 35 may be elevated in the vertical direction as the elevation member 45 is elevated by the operation of the support member 35. Since the specific configuration of the elevation assembly 40 and the configuration of the guide device 50 provided in the drawer part 32 are the same as those in the above-described embodiment, detailed description and illustration thereof will be omitted.

A plurality of containers 361 may be accommodated in the drawer part 32. The container 361 may be a sealed container such as a kimchi passage, and a plurality of the containers 361 may be seated on the support member 35. The container 361 may be elevated together with the support member 35 when the support member 35 is elevated. Thus, in the state in which the container 361 ascends, at least a portion of the drawer part 32 may protrude, and thus, the user may easily lift the container 361.

The support member 35 may interfere with the rotation door 20 in the rotation door 20 is opened even though the drawer door 30 is withdrawn. Thus, the support member 35 may ascend in a state in which the rotation door 20 is closed. For this, a door switch for detecting the opening/closing of the rotation door 20 may be further provided.

Figure 21:
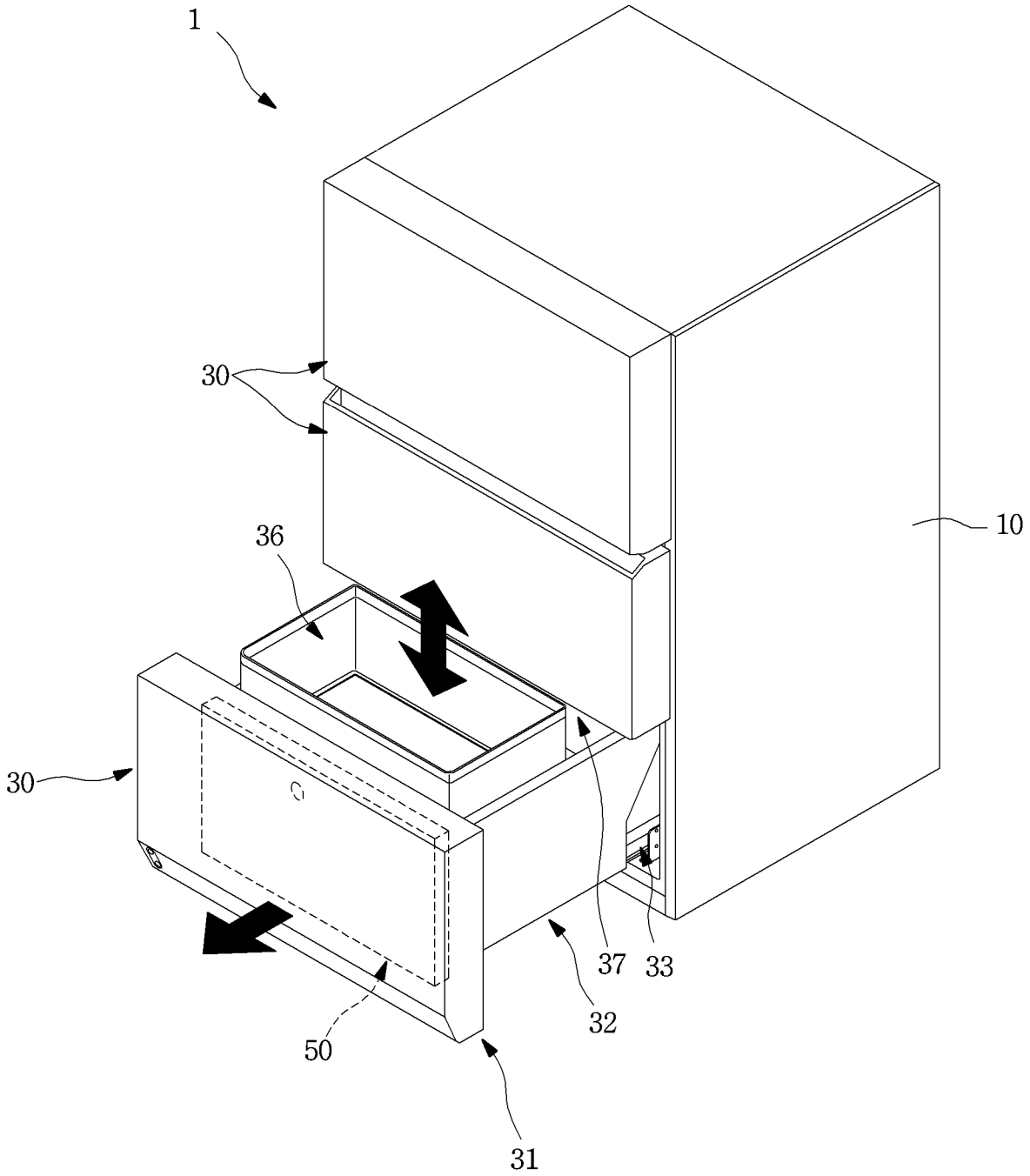
FIG. 21 is a perspective view illustrating a state in which a drawer door of a refrigerator ascends according to another embodiment.

FIG. 21 is a perspective view illustrating a state in which a drawer door of a refrigerator ascends according to another embodiment.

As illustrated in the drawings, a refrigerator 1 according to another embodiment includes a cabinet 10 defining a storage space therein and a door 2 opening and closing an opened front surface of the cabinet 10, which define an outer appearance of the refrigerator 1.

The door 2 may include a drawer door 30 that defines an entire outer appearance of the refrigerator 1 in a state in which the door 2 is closed and is withdrawn forward and backward. A plurality of drawer doors 30 may be continuously disposed in a vertical direction. The drawer doors 30 may be independently inserted and withdrawn by user's manipulation. A support member 35 within the drawer door 30 may be elevated.

The drawer door 30 may include a front panel door part 31 exposed to the outside and opening and closing the front surface of the cabinet 10 and a drawer part 32 for defining a storage space opened upward from the rear surface of the front panel door part 31. The overall configuration of the drawer part 32 may be the same as that of the above-described embodiment, only in the arrangement and size.

Also, the elevation assembly 40 may be provided on the inner side of the front panel door part 31 or on the rear side of the front panel door part 31. The elevation assembly 40 may have the same structure as that of the above-described embodiment. The elevation assembly 40 may be configured such that all of the constituents for driving are disposed in the front panel door part 31. The elevation member 45 may extend inside the drawer part 32 through the drawer part 32, thereby supporting the support member 35 from the lower side.

Thus, the support member 35 may be elevated in the vertical direction as the elevation member 45 is elevated by the operation of the support member 35. Since the specific configuration of the elevation assembly 40 and the configuration of the guide device 50 provided in the drawer part 32 are the same as those in the above-described embodiment, detailed description and illustration thereof will be omitted.

The insertion and withdrawal of the drawer door 30 and the elevation of the support member 35 may be individually performed. After the drawer door 30 is withdrawn, the support member 35 may ascend. Then, after the support member descends, the insertion of the drawer door 30 may be continuously performed.

Also, when the plurality of drawer doors 30 are vertically arranged, the support member 35 inside the drawer door 30, which is relatively downwardly disposed, may be prevented from ascending in a state where the drawer door 30 is relatively drawn upward. Thus, the drawer door 30 may be prevented from interfering with the drawer door 30 in which the food and container are withdrawn upward.

Also, although the support member 35 ascends in the state in which the drawer door 30 that is disposed at the uppermost side is withdrawn in FIG. 21, all of the drawer doors 30 disposed at the upper side may also be elevated by the support members 35 provided inside.

If a height of each of the drawer doors 30 disposed at the upper side is sufficiently high, only the drawer door 30 disposed at the lowermost position or the support member 35 of the plurality of drawer doors 30 disposed relatively downward may be elevated.

Figure 22:
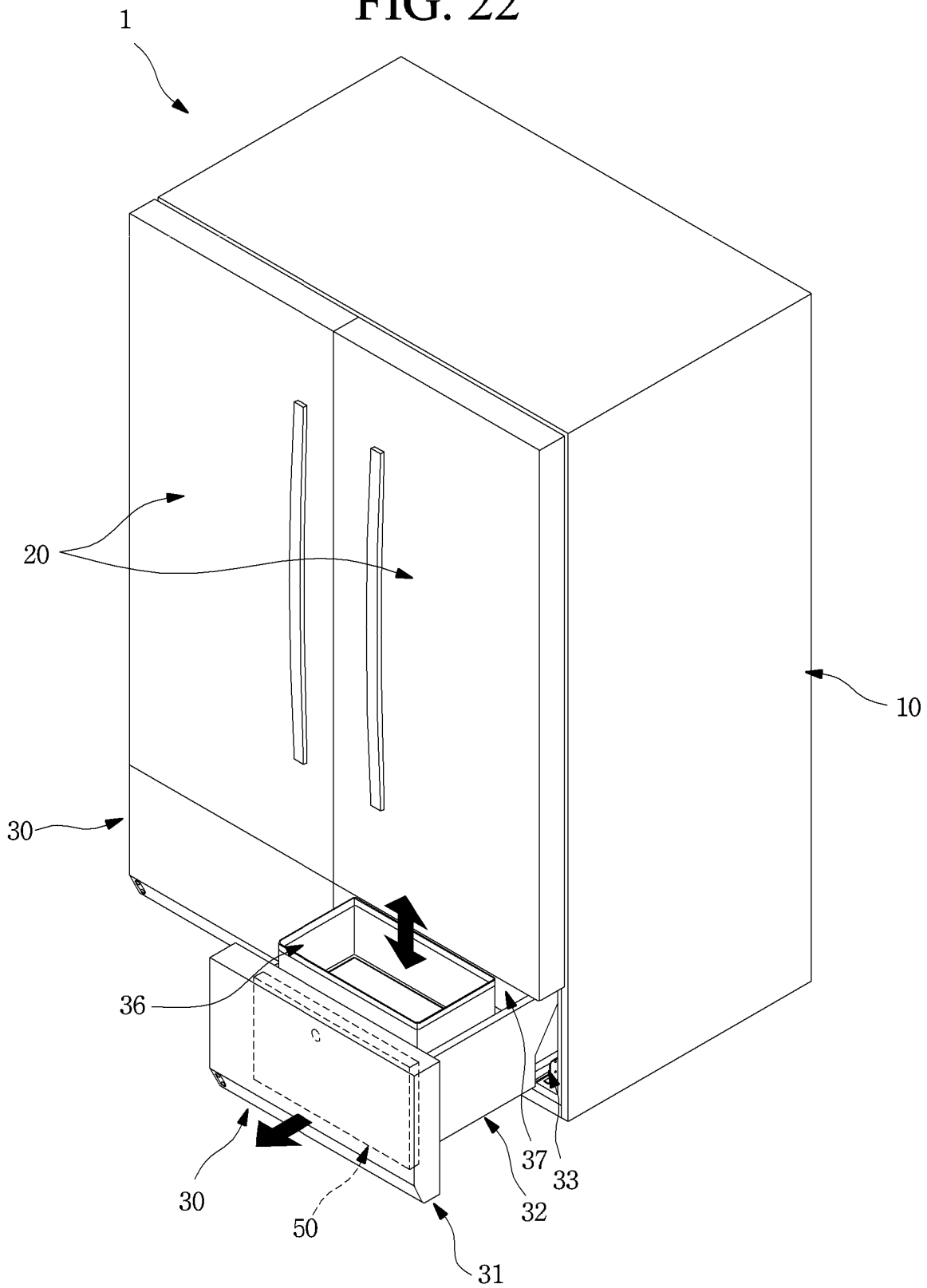
FIG. 22 is a perspective view illustrating a state in which a drawer door of a refrigerator ascends according to another embodiment.

FIG. 22 is a perspective view illustrating a state in which a drawer door of a refrigerator ascends according to another embodiment.

As illustrated in the drawings, a refrigerator 1 according to another embodiment includes a cabinet 10 defining a storage space therein and a door 2 opening and closing an opened front surface of the cabinet 10, which define an outer appearance of the refrigerator 1.

The inside of the cabinet 10 may be divided into an upper space and a lower space. If necessary, the upper and lower storage spaces may be divided again into left and right spaces.

The door 2 may include a rotation door 20 which is provided in an upper portion of the cabinet 10 to open and close the upper storage space and a drawer door 2 disposed in a lower portion of the cabinet 10 to open and close the lower storage space.

Also, the lower space of the cabinet may be divided into left and right spaces. The drawer door 30 may be provided in a pair so that the pair of drawer doors 30 respectively open and close the lower spaces. The pair of drawer doors 30 may be disposed in parallel to each other at left and right sides. The drawer doors 30 may have the same structure.

The drawer door 30 may include a front panel door part 31 exposed to the outside and opening and closing the front surface of the cabinet 10 and a drawer part 32 for defining a storage space opened upward from the rear surface of the front panel door part 31. The overall configuration of the drawer part 32 may be the same as that of the above-described embodiment, only in the arrangement and size.

Also, the elevation assembly 40 may be provided on the inner side of the front panel door part 31 or on the rear side of the front panel door part 31. The elevation assembly 40 may have the same structure as that of the above-described embodiment. The elevation assembly 40 may be configured such that all of the constituents for driving are disposed in the front panel door part 31. The elevation member 45 may extend inside the drawer part 32 through the drawer part 32, thereby supporting the support member 35 from the lower side.

Thus, the support member 35 may be elevated in the vertical direction as the elevation member 45 is elevated by the operation of the support member 35. Since the specific configuration of the elevation assembly 40 and the configuration of the guide device 50 provided in the drawer part 32 are the same as those in the above-described embodiment, detailed description and illustration thereof will be omitted.

The following effects may be expected in the refrigerator according to the proposed embodiments.

The refrigerator according to the embodiment, the portion of the storage space within the drawer door may be elevated in the state in which the drawer door is withdrawn. Thus, when the food is accommodated in the drawer door disposed at the lower side, the user may not excessively turn its back to improve the convenience in use.

Particularly, in order to lift the heavy-weight food or the container containing the food, the user has to lift the food or container with a lot of power. However, the support member within the drawer door may ascend up to a convenient position by driving the elevation assembly to prevent the user from being injured and significantly improve the convenience in use.

Also, the drawer door may be configured by the coupling of the front panel door part and the drawer part, and the elevation assembly for elevating the supporting part may be mounted on the front panel door part.

Thus, the front panel door part and the drawer part may be separated from each other to facilitate service of the elevation assembly, and the inside of the drawer part may be safely and easily cleaned.

Also, the elevating assembly may include the elevation member extending from the front panel door part to the inside of the drawer, and the elevation member may support the support member from the lower side to allow the support member to move vertically.

Thus, the structure for elevating the support member may be covered by the drawer part, and the elevation member may be covered by the support member, thereby improving the appearance and improving the safety of use.

Also, the support member for accommodating the food or container may be provided in the drawer part, and the elevation member passing from the front panel door part to the drawer part may elevate the support member. Thus, the support member may be elevated inside the drawer part, and the exposure of the mechanism device for the elevation may be prevented.

Also, the support member inside the drawer part may be elevated, but not the entire drawer part, and the support member may move vertically stably without moving or separating.

Also, the support member may have the structure corresponding to the front space at the inside of the drawer part defined by the front space and the rear space. The drawer part may be disposed outside the cabinet, and the rear space may be disposed inside the cabinet. Also, the support member may have the structure in which at least a part of the rear space is elevated while being disposed inside the cabinet.

Thus, in such a structure, the draw-out distance of the drawer part may become shorter than that according to the related art, and the elevation may be performed in the more stable state. Also, the stability and durability may be improved due to the restriction of the draw-out distance, and there may be no need to provide the additional reinforcement structure of the structure for inserting and withdrawing the door.

Also, the drawer part may be provided with the guide device for defining the space through which the elevation member passes and the path through which the elevation member moves vertically so that elevation of the elevation member or elevation of the support member are facilitated.

Also, the guide device may be provided with the guide member which covers the guide hole through which the elevation member passes when the elevation member is elevated to cover the path of the elevation member, thereby preventing the portion opened to the inside of the drawer part from being exposed.

Thus, the space opened into the drawer part may not be exposed to prevent the food or the user's body from being caught by the foreign body or the foreign body, thereby improving the safety in use and improving the outer appearance.

Also, the guide device may be covered by the plurality of shutters that move vertically by the elevation member. In the guide hole is covered, the plurality of shutters as well as the inner surface of the drawer part may be disposed on the same plane to more improve the outer appearance, and the outer plate may be made of the same material as the inner plate that defines the inner side of the drawer part, thereby further improving the outer appearance.

Also, the plurality of shutters may move together when the elevation member ascends and when the lifting member descends, the elevation member may move downward by its own weight. Thus, the guide hole may be opened and closed through the simple structure without separate power.

Also, the elevation member may have the structure that is capable of being easily separated from the elevation assembly and have the structure that is capable of being detached through the opening of the guide.

Thus, the elevation function inside the drawer part may be selectively used. That is, the elevation member may be easily separated if it is desired to increase the capacity of the drawer part without using the elevation function, and the elevation member may be mounted when the elevation function is to be used. The elevation member may be easily attached and detached in the state in which the front panel door part and the drawer part are coupled to each other without separating the entire elevation assembly.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet that defines an upper storage space and a lower storage space;

a front panel door part configured to open and close at least a portion of the lower storage space;

a drawer part connected to the front panel door part and configured to insert into and withdraw from the lower storage space together with the front panel door part;

a support member located at the drawer part and configured to seat an object stored in the drawer part; and an elevation assembly located at the front panel door part and configured to elevate the support member relative to the drawer part, wherein the elevation assembly comprises:

at least one elevation member that extends from the front panel door part to the drawer part, that is configured to pass through at least a portion of the drawer part, and that is located vertically below the support member, with the at least one elevation member being configured to support the support member, a driving device that is located in the front panel door part, that is configured to provide power to the at least one elevation member, and that is configured to cause a vertical movement of the at least one elevation member relative to the drawer part, a frame configured to be fixed to a rear surface of the front panel door part, with the frame defining a frame space configured to accommodate the driving device therein, a pair of elevation shafts respectively located at sides of the frame space and configured to be rotated by the driving device, and an elevation block that defines openings respectively penetrated by the pair of elevation shafts, that defines a screw thread at each of the openings of the elevation block, and that is configured to move in a vertical direction along the pair of elevation shafts based on rotation of the pair of elevation shafts, wherein the at least one elevation member is coupled to the elevation block, and wherein the driving device comprises:

an elevation motor located between the pair of elevation shafts, and a gear assembly comprising a plurality of gears that are configured to connect the elevation motor to the pair of elevation shafts and that allow the pair of elevation shafts to simultaneously rotate at a same rotation rate.

2. The refrigerator according to claim 1, wherein the drawer part defines:

a front space disposed forward in a direction in which the drawer part is configured to withdraw from the lower storage space of the cabinet; and a rear space disposed rearward of the front space, and wherein the support member is arranged in the front space.

3. The refrigerator according to claim 2, wherein the at least one elevation member is configured to pass through a front surface of the drawer part and to extend to an inside of the front space of the drawer part.

4. The refrigerator according to claim 2, wherein the elevation assembly is configured to perform the vertical movement of the at least one elevation member in a state in which the front space of the drawer part is completely exposed to an outside of the cabinet.

5. The refrigerator according to claim 2, wherein the drawer part comprises a drawer cover configured to partition an inner space of the drawer part into the front space and the rear space, with the drawer cover being configured to cover the rear space.

6. The refrigerator according to claim 2, wherein the support member has a plate shape and a size corresponding to an interior of the front space of the drawer part.

7. The refrigerator according to claim 1, wherein the at least one elevation member comprises a pair of elevation members spaced apart from each other in a lateral direction, and wherein the drawer part defines a pair of openings at a front surface of the drawer part at positions corresponding to the pair of elevation members, the pair of openings extending in the vertical direction to allow the vertical movement of the pair of elevation members.

8. The refrigerator according to claim 1, wherein the front panel door part defines a recessed space at the rear surface of the front panel door part, with the recessed space being configured to accommodate the elevation assembly therein, and wherein a front surface of the drawer part is configured to cover at least a portion of the elevation assembly.

9. The refrigerator according to claim 1, wherein the elevation motor is located at a bottom surface of an inside of the frame, the elevation motor comprising a rotation shaft that passes through the frame, and wherein the gear assembly is arranged at a bottom surface of an outside of the frame and connected to the rotation shaft of the elevation motor.

10. The refrigerator according to claim 1, wherein the elevation block defines a motor groove recessed from a surface of the elevation block and configured to receive the elevation motor based on the elevation block moving downward in the vertical direction along the pair of elevation shafts.

11. The refrigerator according to claim 1, further comprising at least one guide device located at a front surface of the drawer part, the at least one guide device defining at least one guide opening configured to receive the at least one elevation member and to guide the vertical movement of the at least one elevation member in a state in which the elevation member passes through the at least one guide opening.

12. The refrigerator according to claim 11, wherein each of the at least one guide device comprises:

a guide frame located in a drawer opening defined at the front surface of the drawer part, the guide frame defining the guide opening;

a plurality of shutters that are arranged in the guide opening in the vertical direction and that are configured to cover the guide opening; and a shutter guide part located at each of both left and right surfaces of the guide opening and configured to guide the plurality of shutters to move up and down along the vertical direction, wherein the at least one elevation member is configured to:

pass through the at least one guide opening from a lower side of the plurality of shutters; and based on the at least one elevation member moving in an upward direction, push the lower side of the plurality of shutters in the upward direction to allow the plurality of shutters to move in the upward direction, and wherein the plurality of shutters are configured to move in a downward direction by a weight of the plurality of shutters based on the at least one elevation member moving in the downward direction.

13. The refrigerator according to claim 12, wherein the shutter guide part comprises a plurality of guides that extend in the vertical direction, that define recesses configured to accommodate ends of the plurality of shutters, and that define a moving path of the plurality of shutters, wherein a number of the plurality of guides correspond to a number of the plurality of shutters, wherein at least portions of the plurality of guides are spaced apart from each other in a front-rear direction, and wherein the plurality of shutters are configured to overlap each other in the front-rear direction based on the plurality of shutters moving upward.

14. The refrigerator according to claim 13, wherein each of the plurality of shutters comprises:

upper protrusions that protrude laterally outward from upper ends of both sides of the shutter; and lower protrusions that protrude laterally outward from lower ends of both sides of the shutter, wherein each of the plurality of guides of the shutter guide part comprises:

upper grooves configured to receive the upper protrusions of the shutter, respectively, with the upper grooves extending in an inclined direction with respect to the vertical direction, and lower grooves configured to receive the lower protrusions of the shutter, respectively, with the lower grooves extending in the inclined direction, and wherein outer surfaces of the plurality of shutters are configured to define one plane in a state in which the plurality of shutters are positioned at a lowermost position based on the upper protrusions being inserted into the upper grooves and the lower protrusions being inserted into the lower grooves.

15. The refrigerator according to claim 14, wherein the guide opening is configured to be closed in the state in the plurality of shutters are positioned at the lowermost position, and wherein an inner surface of the drawer part is on the one plane defined by the outer surfaces of the plurality of shutters in a state in which the guide opening is closed.

16. The refrigerator according to claim 13, wherein the each of the at least one guide device further comprises a cover part located vertically above the guide opening and configured to cover all of the plurality of shutters that overlap each other in a state in which the plurality of shutters have moved upward, and wherein each of the plurality of guides of the shutter guide part extends from a front side of the cover part to an upper end of the cover part.

17. The refrigerator according to claim 12, wherein the plurality of shutters comprise:

a lower shutter disposed at a lower side; and an upper shutter disposed at an upper side, wherein the lower shutter comprises a shutter bent part that is bent from an upper end of the lower shutter and that is configured to seat a lower end of the upper shutter.

18. The refrigerator according to claim 12, wherein the drawer part comprises a plurality of plates that define an inner surface of the drawer part, each of the plurality of plates being made of a metal material, and wherein each of the plurality of shutters is made of the metal material.

* * * * *